US009060236B2

(12) United States Patent
Engdegard et al.

(10) Patent No.: US 9,060,236 B2
(45) Date of Patent: Jun. 16, 2015

(54) APPARATUS FOR PROVIDING AN UPMIX SIGNAL REPRESENTATION ON THE BASIS OF A DOWNMIX SIGNAL REPRESENTATION, APPARATUS FOR PROVIDING A BITSTREAM REPRESENTING A MULTI-CHANNEL AUDIO SIGNAL, METHODS, COMPUTER PROGRAM AND BITSTREAM USING A DISTORTION CONTROL SIGNALING

(75) Inventors: Jonas Engdegard, Stockholm (SE); Heiko Purnhagen, Sundbyberg (SE); Juergen Herre, Buckenhof (DE); Leon Terentiv, Erlangen (DE); Cornelia Falch, Rum (AT); Oliver Hellmuth, Erlangen (DE)

(73) Assignees: Dolby International AB, Amsterdam Zuid-Oost (NL); Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 339 days.

(21) Appl. No.: 13/450,027

(22) Filed: Apr. 18, 2012

(65) Prior Publication Data

US 2012/0243690 A1 Sep. 27, 2012

Related U.S. Application Data

(63) Continuation of application No. PCT/EP2010/065671, filed on Oct. 19, 2010.

(60) Provisional application No. 61/369,260, filed on Jul. 30, 2010, provisional application No. 61/253,237, filed on Oct. 20, 2009.

(30) Foreign Application Priority Data

Jul. 30, 2010 (EP) ..... 10171418

(51) Int. Cl.
*H04R 5/00* (2006.01)
(Continued)

(52) U.S. Cl.
CPC ..... *H04S 3/008* (2013.01); *G10L 19/008* (2013.01); *H04S 2420/03* (2013.01)

(58) Field of Classification Search
CPC ..... H04R 5/00; G10L 19/00; G10L 21/00
USPC ..... 381/17, 22–23, 20; 704/500–504
See application file for complete search history.

(56) References Cited

U.S. PATENT DOCUMENTS 7,983,922 B2 * 7/2011 Neusinger et al. ..... 704/500
8,258,849 B2 * 9/2012 Lee et al. ..... 327/334

(Continued)

FOREIGN PATENT DOCUMENTS

CN 101138274 A 3/2008
JP 2008-511849 A 4/2008

(Continued)

OTHER PUBLICATIONS

Official Communication issued in International Patent Application No. PCT/EP2010/065671, mailed on Feb. 7, 2011.

(Continued)

*Primary Examiner* — Disler Paul
(74) *Attorney, Agent, or Firm* — Keating & Bennett, LLP

(57) ABSTRACT

An apparatus for providing an upmix signal representation on the basis of a downmix signal representation and an object-related parametric information, which are included in a bitstream representation of an audio content, and in dependence on a rendering information, has a distortion limiter configured to adjust upmix parameters using a distortion control scheme to avoid or limit audible distortions which are caused by an inappropriate choice of rendering parameters. The distortion limiter is configured to obtain a distortion limitation control parameter, which is included in the bitstream representation of the audio content, and to adjust a distortion control scheme in dependence on the distortion limitation control parameter.

19 Claims, 10 Drawing Sheets

(51) Int. Cl.

| | |
|---|---|
| ***G10L 19/00*** | (2013.01) |
| ***G10L 21/00*** | (2013.01) |
| ***H04S 3/00*** | (2006.01) |
| ***G10L 19/008*** | (2013.01) |

(56) References Cited

U.S. PATENT DOCUMENTS

| | | | | |
|---|---|---|---|---|
| 8,532,999 | B2 * | 9/2013 | Neusinger et al. | 704/500 |
| 2005/0228648 | A1 | 10/2005 | Heikkinen | |
| 2006/0239473 | A1 | 10/2006 | Kjorling et al. | |
| 2008/0002842 | A1 * | 1/2008 | Neusinger et al. | 381/119 |
| 2009/0003635 | A1 | 1/2009 | Pang et al. | |
| 2009/0028344 | A1 * | 1/2009 | Pang et al. | 381/1 |
| 2010/0217586 | A1 | 8/2010 | Shimada et al. | |
| 2011/0235810 | A1 | 9/2011 | Neusinger et al. | |

FOREIGN PATENT DOCUMENTS

| | | | |
|---|---|---|---|
| JP | 2008-536183 | A | 9/2008 |
| JP | 2009-524341 | A | 6/2009 |
| WO | 2008/069597 | A1 | 6/2008 |
| WO | 2008/100067 | A1 | 8/2008 |
| WO | 2009/051132 | A1 | 4/2009 |

OTHER PUBLICATIONS

Faller et al., "Binaural Cue Coding—Part II: Schemes and Applications," IEEE Transactions on Speech and Audio Processing, vol. 11, No. 6, Nov. 2003, pp. 520-531.

Faller, "Parametric Joint-Coding of Audio Sources," AES 120th Convention, Convention Paper 6752, May 20-23, 2006, pp. 1-12, Paris, France.

Herre et al., "From SAC to SAOC—Recent Developments in Parametric Coding of Spatial Audio," AES 22nd UK Conference, Illusions in Sound, Apr. 2007, pp. 12-1 to 12-8.

Engdegard et al., "Spatial Audio Object Coding (SAOC)—The Upcoming MPEG Standard on Parametric Object Based Audio Coding," AES 124th Convention, Convention Paper 7377, May 17-20, 2008, pp. 1-15, Amsterdam, The Netherlands.

"Information Technologies—MPEG Audio Technologies—Part 2: Spatial Audio Object Coding (SAOC)," ISO/IEC JTC1, 2010,138 pages.

Dietz et al., "Spectral Band Replication, a novel approach in audio coding," AES 112th Convention, Convention Paper 5553, May 10-13, 2002, pp. 1-8, Munich, Germany.

Schuijers et al., "Low complexity parametric stereo coding," AES 116th Convention, Convention Paper 6073, May 8-11, 2004, pp. 1-11, Berlin, Germany.

Herre et al., "MPEG Surround—The ISO/MPEG Standard for Efficient and Compatible Multichannel Audio Coding," J. Audio Eng. Soc., vol. 56, No. 11, Nov. 2008, pp. 932-955.

English translation of Official Communication issued in corresponding Taiwanese Patent Application No. 99135552, mailed on Mar. 8, 2013.

Official Communication issued in corresponding Chinese Patent Application No. 201080047331.0, mailed on Jan. 18, 2013.

Official Communication issued in corresponding Japanese Patent Application No. 2012-534658, mailed on Jul. 30, 2013.

Official Communication issued in corresponding Japanese Patent Application No. 2012-534658, mailed on Mar. 3, 2015.

* cited by examiner

An example for SAOC distortion control

MPG SAOC system overview

APPARATUS FOR PROVIDING AN UPMIX SIGNAL REPRESENTATION ON THE BASIS OF A DOWNMIX SIGNAL REPRESENTATION, APPARATUS FOR PROVIDING A BITSTREAM REPRESENTING A MULTI-CHANNEL AUDIO SIGNAL, METHODS, COMPUTER PROGRAM AND BITSTREAM USING A DISTORTION CONTROL SIGNALING

CROSS-REFERENCE TO RELATED APPLICATIONS

This application is a continuation of copending International Application No. PCT/EP2010/065671, filed Oct. 19, 2010, which is incorporated herein by reference in its entirety, and additionally claims priority from U.S. Application Nos. 61/253,237, filed Oct. 20, 2009, 61/369,260, filed Jul. 30, 2010, and EP 10171418.6, filed Jul. 30, 2010, all of which are incorporated herein by reference in their entirety.

Embodiments according to the invention are related to an apparatus for providing an upmix signal representation on the basis of a downmix signal representation and an object-related parametric information, which are included in a bitstream representation of an audio content, and a rendering information.

Another embodiment according to the invention is related to an apparatus for providing a bitstream representing a multi-channel audio signal.

Another embodiment according to the invention is related to a method for providing an upmix signal representation on the basis of a downmix signal representation and an object-related parametric information, which are included in a bitstream representation of the audio content, and a rendering information.

Another embodiment according to the invention is related to a method for providing a bitstream representing a multi-channel audio signal.

Another embodiment according to the invention is related to a computer program implementing one of the methods.

Another embodiment according to the invention is related to a bitstream representing a multi-channel audio signal.

BACKGROUND OF THE INVENTION

In the art of audio processing, audio transmission and audio storage, there is an increasing desire to handle multi-channel contents in order to improve the hearing impression. Usage of multi-channel audio content brings along significant improvements for the user. For example, a 3-dimensional hearing impression can be obtained, which brings along an improved user satisfaction in entertainment applications. However, multi-channel audio contents are also useful in professional environments, for example in telephone conferencing applications, because the speaker intelligibility can be improved by using a multi-channel audio playback.

However, it is also desirable to have a good tradeoff between audio quality and bitrate requirements in order to avoid an excessive resource load caused by multi-channel applications.

Recently, parametric techniques for the bitrate-efficient transmission and/or storage of audio scenes containing multiple audio objects have been proposed, for example, Binaural Cue Coding (Type I) (see, for example reference [BCC]), Joint Source Coding (see, for example, reference [JSC]), and MPEG Spatial Audio Object Coding (SAOC) (see, for example, references [SAOC1], [SAOC2] and non-prepublished reference [SAOC]).

These techniques aim at perceptually reconstructing the desired output audio scene rather than a waveform match.

FIG. 8 shows a system overview of such a system (here: MPEG SAOC). The MPEG SAOC system 800 shown in FIG. 8 comprises an SAOC encoder 810 and an SAOC decoder 820. The SAOC encoder 810 receives a plurality of object signals $x_1$ to $x_N$, which may be represented, for example, as time-domain signals or as time-frequency-domain signals (for example, in the form of a set of transform coefficients of a Fourier-type transform, or in the form of QMF subband signals). The SAOC encoder 810 typically also receives downmix coefficients $d_1$ to $d_N$, which are associated with the object signals $x_1$ to $x_N$. Separate sets of downmix coefficients may be available for each channel of the downmix signal. The SAOC encoder 810 is typically configured to obtain a channel of the downmix signal by combining the object signals $x_1$ to $x_N$ in accordance with the associated downmix coefficients $d_1$ to $d_N$. Typically, there are less downmix channels than object signals $x_1$ to $x_N$. In order to allow (at least approximately) for a separation (or separate treatment) of the object signals at the side of the SAOC decoder 820, the SAOC encoder 810 provides both the one or more downmix signals (designated as downmix channels) 812 and a side information 814. The side information 814 describes characteristics of the object signals $x_1$ to $x_N$, in order to allow for a decoder-sided object-specific processing.

The SAOC decoder 820 is configured to receive both the one or more downmix signals 812 and the side information 814. Also, the SAOC decoder 820 is typically configured to receive a user interaction information and/or a user control information 822, which describes a desired rendering setup. For example, the user interaction information/user control information 822 may describe a speaker setup and the desired spatial placement of the objects which provide the object signals $x_1$ to $x_N$.

The SAOC decoder 820 is configured to provide, for example, a plurality of decoded upmix channel signals $\hat{y}_1$ to $\hat{y}_M$. The upmix channel signals may for example be associated with individual speakers of a multi-speaker rendering arrangement. The SAOC decoder 820 may, for example, comprise an object separator 820*a*, which is configured to reconstruct, at least approximately, the object signals $x_1$ to $x_N$ on the basis of the one or more downmix signals 812 and the side information 814, thereby obtaining reconstructed object signals 820*b*. However, the reconstructed object signals 820*b* may deviate somewhat from the original object signals $x_1$ to $x_N$, for example, because the side information 814 is not quite sufficient for a perfect reconstruction due to the bitrate constraints. The SAOC decoder 820 may further comprise a mixer 820*c*, which may be configured to receive the reconstructed object signals 820*b* and the user interaction information/user control information 822, and to provide, on the basis thereof, the upmix channel signals $\hat{y}_1$ to $\hat{y}_M$. The mixer 820*c* may be configured to use the user interaction information/user control information 822 to determine the contribution of the individual reconstructed object signals 820*b* to the upmix channel signals $\hat{y}_1$ to $\hat{y}_M$. The user interaction information/user control information 822 may, for example, comprise rendering parameters (also designated as rendering coefficients), which determine the contribution of the individual reconstructed object signals 822 to the upmix channel signals $\hat{y}_1$ to $\hat{y}_M$.

However, it should be noted that in many embodiments, the object separation, which is indicated by the object separator

820*a* in FIG. 8, and the mixing, which is indicated by the mixer 820*c* in FIG. 8, are performed in single step. For this purpose, overall parameters may be computed which describe a direct mapping of the one or more downmix signals 812 onto the upmix channel signals $\hat{y}_1$ to $\hat{y}_M$. These parameters may be computed on the basis of the side information and the user interaction information/user control information 822.

Taking reference now to FIGS. 9*a*, 9*b* and 9*c*, different apparatus for obtaining an upmix signal representation on the basis of a downmix signal representation and object-related side information will be described. FIG. 9*a* shows a block schematic diagram of an MPEG SAOC system 900 comprising an SAOC decoder 920. The SAOC decoder 920 comprises, as separate functional blocks, an object decoder 922 and a mixer/renderer 926. The object decoder 922 provides a plurality of reconstructed object signals 924 in dependence on the downmix signal representation (for example, in the form of one or more downmix signals represented in the time domain or in the time-frequency-domain) and object-related side information (for example, in the form of object meta data). The mixer/renderer 926 receives the reconstructed object signals 924 associated with a plurality of N objects and provides, on the basis thereof, one or more upmix channel signals 928. In the SAOC decoder 920, the extraction of the object signals 924 is performed separately from the mixing/rendering which allows for a separation of the object decoding functionality from the mixing/rendering functionality but brings along a relatively high computational complexity.

Taking reference now to FIG. 9*b*, another MPEG SAOC system 930 will be briefly discussed which comprises an SAOC decoder 950. The SAOC decoder 950 provides a plurality of upmix channel signals 958 in dependence on a downmix signal representation (for example, in the form of one or more downmix signals) and an object-related side information (for example, in the form of object meta data). The SAOC decoder 950 comprises a combined object decoder and mixer/renderer, which is configured to obtain the upmix channel signals 958 in a joint mixing process without a separation of the object decoding and the mixing/rendering, wherein the parameters for said joint upmix process are dependent both on the object-related side information and the rendering information. The joint upmix process depends also on the downmix information, which is considered to be part of the object-related side information.

To summarize the above, the provision of the upmix channel signals 928, 958 can be performed in a one step process or a two step process.

Taking reference now to FIG. 9*c*, an MPEG SAOC system 960 will be described. The SAOC system 960 comprises an SAOC to MPEG Surround transcoder 980, rather than an SAOC decoder.

The SAOC to MPEG Surround transcoder comprises a side information transcoder 982, which is configured to receive the object-related side information (for example, in the form of object meta data) and, optionally, information on the one or more downmix signals and the rendering information. The side information transcoder is also configured to provide an MPEG Surround side information (for example, in the form of an MPEG Surround bitstream) on the basis of a received data. Accordingly, the side information transcoder 982 is configured to transform an object-related (parametric) side information, which is received from the object encoder, into a channel-related (parametric) side information, taking into consideration the rendering information and, optionally, the information about the content of the one or more downmix signals.

Optionally, the SAOC to MPEG Surround transcoder 980 may be configured to manipulate the one or more downmix signals, described, for example, by the downmix signal representation, to obtain a manipulated downmix signal representation 988. However, the downmix signal manipulator 986 may be omitted, such that the output downmix signal representation 988 of the SAOC to MPEG Surround transcoder 980 is identical to the input downmix signal representation of the SAOC to MPEG Surround transcoder. The downmix signal manipulator 986 may, for example, be used if the channel-related MPEG Surround side information 984 would not allow to provide a desired hearing impression on the basis of the input downmix signal representation of the SAOC to MPEG Surround transcoder 980, which may be the case in some rendering constellations.

Accordingly, the SAOC to MPEG Surround transcoder 980 provides the downmix signal representation 988 and the MPEG Surround bitstream 984 such that a plurality of upmix channel signals, which represent the audio objects in accordance with the rendering information input to the SAOC to MPEG Surround transcoder 980 can be generated using an MPEG Surround decoder which receives the MPEG Surround bitstream 984 and the downmix signal representation 988.

To summarize the above, different concepts for decoding SAOC-encoded audio signals can be used. In some cases, a SAOC decoder is used, which provides upmix channel signals (for example, upmix channel signals 928, 958) in dependence on the downmix signal representation and the object-related parametric side information. Examples for this concept can be seen in FIGS. 9*a* and 9*b*. Alternatively, the SAOC-encoded audio information may be transcoded to obtain a downmix signal representation (for example, a downmix signal representation 988) and a channel-related side information (for example, the channel-related MPEG Surround bitstream 984), which can be used by an MPEG Surround decoder to provide the desired upmix channel signals.

In the MPEG SAOC system 800, a system overview of which is given in FIG. 8, the general processing is carried out in a frequency selective way and can be described as follows within each frequency band:

N input audio object signals $x_1$ to $x_N$ are downmixed as part of the SAOC encoder processing. For a mono downmix, the downmix coefficients are denoted by $d_1$ to $d_N$. In addition, the SAOC encoder 810 extracts side information 814 describing the characteristics of the input audio objects. For MPEG SAOC, the relations of the object powers with respect to each other are the most basic form of such a side information.

Downmix signal (or signals) 812 and side information 814 are transmitted and/or stored. To this end, the downmix audio signal may be compressed using well-known perceptual audio coders such as MPEG-1 Layer II or III (also known as ".mp3"), MPEG Advanced Audio Coding (AAC), or any other audio coder.

On the receiving end, the SAOC decoder 820 conceptually tries to restore the original object signal ("object separation") using the transmitted side information 814 (and, naturally, the one or more downmix signals 812). These approximated object signals (also designated as reconstructed object signals 820*b*) are then mixed into a target scene represented by M audio output channels (which may, for example, be represented by the upmix channel signals $\hat{y}_1$ to $\hat{y}_M$) using a rendering matrix. For a mono output, the rendering matrix coefficients are given by $r_1$ to $r_N$ Effectively, the separation of the object signals is rarely executed (or even never executed), since both the separation step (indicated by the object separator 820*a*) and the mixing step (indicated by the mixer 820*c*) are combined into a single transcoding step, which often results in an enormous reduction in computational complexity.

It has been found that such a scheme is tremendously efficient, both in terms of transmission bitrate (it is only useful to transmit a few downmix channels plus some side information instead of N (typically discrete) object audio signals plus optional rendering information or a discrete system) and computational complexity (the processing complexity relates mainly to the number of output channels rather than the number of audio objects). Further advantages for the user on the receiving end include the freedom of choosing a rendering setup of his/her choice (mono, stereo, surround, virtualized headphone playback, and so on) and the feature of user interactivity: the rendering matrix, and thus the output scene, can be set and changed interactively by the user according to will, personal preference or other criteria. For example, it is possible to locate the talkers from one group together in one spatial area to maximize discrimination from other remaining talkers. This interactivity is achieved by providing a decoder user interface:

For each transmitted sound object, its relative level and (for non-mono rendering) spatial position of rendering can be adjusted. This may happen in real-time as the user changes the position of the associated graphical user interface (GUI) sliders (for example: object level=+5 dB, object position=−30 deg).

However, it has been found that the decoder-sided choice of parameters for the provision of the upmix signal representation (e.g. the upmix channel signals $\hat{y}_1$ to $\hat{y}_M$) brings along audible degradations in some cases.

It has been found that due to the downmix/separation/mix-based parametric approach, the subjective quality of the audio output depends on the rendering parameter settings. It was found that changes in relative object level affect the final audio quality more than changes in spatial rendering position ("re-panning"). Extreme settings for relative level parameters (e.g. +20 dB) can even lead to an unacceptable output quality.

While this is simply a result of violating some of the perceptual assumptions that underlie this scheme, it is still unacceptable for a commercial product to produce bad sound and artifacts depending on the settings on the user interface.

U.S. Patent Application 61/173,456 entitled "Methods, Apparatus, and Computer Programs for Distortion Avoiding Audio Signal Processing" and International Patent Application PCT/EP2010/055717 entitled "Apparatus for Providing One or More Adjusted Parameters for the Provision of an Upmix Signal Representation on the Basis of a Downmix Signal Representation, Audio Signal Decoder, Audio Signal Transcoder, Audio Signal Encoder, Audio Bitstream, Method and Computer Program using an Object-related Parametric Information" (from hereon referenced to as "example for a distortion control") describe a process for mitigating the distortion from object gain modification in an SAOC system. Said documents describe different concepts for distortion control and distortion reduction, which concepts can be applied within or in combination with embodiments according to the invention.

In view of the above discussion, it is an object of the present invention to create a concept which allows for an improved reduction or avoidance of distortions when providing an upmix signal representation on the basis of a downmix signal representation.

SUMMARY

According to an embodiment, an apparatus for providing an upmix signal representation on the basis of a downmix signal representation and an object-related parametric information, which are part of a bitstream representation of an audio content, and in dependence on a rendering information may have: a distortion limiter configured to adjust upmix parameters using a distortion control scheme to avoid or limit audible distortions which are caused by an inappropriate choice of rendering parameters, wherein the distortion limiter is configured to acquire a distortion limitation control parameter which is part of the bitstream representation of the audio content, and to adjust the distortion control scheme in dependence on the distortion limitation control parameter; wherein the distortion limiter is configured to evaluate a dynamic update flag within a configuration portion of the bitstream representation of the audio content, and wherein the distortion limiter is configured to evaluate the configuration portion of the bitstream representation of the audio content, to acquire the distortion limitation control parameter, if the dynamic update flag is inactive, and to evaluate a frame portion of the bitstream representation of the audio content, to repeatedly acquire updates of the distortion limitation control parameter, if the dynamic update flag is active.

According to another embodiment, an apparatus for providing a bitstream representing a multi-channel audio signal may have: a downmixer configured to provide a downmix signal on the basis of a plurality of audio object signals; a side information provider configured to provide an object-related parametric side information describing characteristics of the audio object signals and downmix parameters, and one or more distortion limitation control parameters for controlling the application of a distortion control scheme at the side of an apparatus for providing an upmix signal representation; and a bitstream formatter configured to provide a bitstream having a representation of the downmix signal, the object-related parametric side information and the one or more distortion limitation control parameters; wherein the apparatus is configured to provide the bitstream such that a configuration portion of the bitstream has a dynamic update flag, and such that the configuration portion of the bitstream has the distortion limitation control parameter, if the dynamic update flag is inactive, and such that a frame portion of the bitstream has repeated updates of the distortion limitation control parameter, if the dynamic update flag is active.

According to another embodiment, a method for providing an upmix signal representation on the basis of a downmix signal representation and an object-related parametric information, which are part of a bitstream representation of an audio content, and in dependence on a rendering information may have the steps of: adjusting upmix parameters using a distortion control scheme, to avoid or limit audible distortions which are caused by an inappropriate choice of rendering parameters, wherein a distortion limitation control parameter, which is part of the bitstream representation of the audio content, is acquired, and wherein the distortion control scheme is adjusted in dependence on the distortion limitation control parameter, wherein a dynamic update flag within a configuration portion of the bitstream representation of the audio content is evaluated, and wherein the configuration portion of the bitstream representation of the audio content is evaluated, to acquire the distortion limitation control parameter, if the dynamic update flag is inactive, and wherein a frame portion of the bitstream representation of the audio content is evaluated, to repeatedly acquire updates of the distortion limitation control parameter, if the dynamic update flag is active.

According to another embodiment, a method for providing a bitstream representing a multi-channel audio signal may have the steps of: deriving a downmix signal on the basis of a plurality of audio object signals; providing an object-related parametric side information describing characteristics of the audio object signals and downmix parameters; providing one or more distortion limitation control parameters for controlling the application of a distortion control scheme at the side of an apparatus for providing an upmix signal representation; and providing a bitstream having a representation of the downmix signal, the object-related parametric side information and the one or more distortion limitation control parameters, wherein the bitstream is provided such that a configuration portion of the bitstream has a dynamic update flag, and such that the configuration portion of the bitstream has the distortion limitation control parameter, if the dynamic update flag is inactive, and such that a frame portion of the bitstream has repeated updates of the distortion limitation control parameter, if the dynamic update flag is active.

Another embodiment may have a computer program for performing the method for providing an upmix signal representation on the basis of a downmix signal representation and an object-related parametric information, which are part of a bitstream representation of an audio content, and in dependence on a rendering information, which method may have the steps of: adjusting upmix parameters using a distortion control scheme, to avoid or limit audible distortions which are caused by an inappropriate choice of rendering parameters, wherein a distortion limitation control parameter, which is part of the bitstream representation of the audio content, is acquired, and wherein the distortion control scheme is adjusted in dependence on the distortion limitation control parameter, wherein a dynamic update flag within a configuration portion of the bitstream representation of the audio content is evaluated, and wherein the configuration portion of the bitstream representation of the audio content is evaluated, to acquire the distortion limitation control parameter, if the dynamic update flag is inactive, and wherein a frame portion of the bitstream representation of the audio content is evaluated, to repeatedly acquire updates of the distortion limitation control parameter, if the dynamic update flag is active, when the computer program runs on a computer.

Another embodiment may have a computer program for performing the method for providing a bitstream representing a multi-channel audio signal, which method may have the steps of: deriving a downmix signal on the basis of a plurality of audio object signals; providing an object-related parametric side information describing characteristics of the audio object signals and downmix parameters; providing one or more distortion limitation control parameters for controlling the application of a distortion control scheme at the side of an apparatus for providing an upmix signal representation; and providing a bitstream having a representation of the downmix signal, the object-related parametric side information and the one or more distortion limitation control parameters, wherein the bitstream is provided such that a configuration portion of the bitstream has a dynamic update flag, and such that the configuration portion of the bitstream has the distortion limitation control parameter, if the dynamic update flag is inactive, and such that a frame portion of the bitstream has repeated updates of the distortion limitation control parameter, if the dynamic update flag is active, when the computer program runs on a computer.

According to another embodiment, a bitstream representing a multi-channel audio signal may have: a representation of a downmix signal combining audio signals of a plurality of audio objects; an object-related parametric side information describing characteristics of the audio objects; and one or more distortion limitation control parameters for controlling the application of a distortion control scheme at the side of an apparatus for providing an upmix signal representation; wherein a configuration portion of the bitstream has a dynamic update flag, and wherein the configuration portion of the bitstream has the distortion limitation control parameter, if the dynamic update flag is inactive, and wherein the frame portion of the bitstream has repeated updates of the distortion limitation control parameter, if the dynamic update flag is active.

An embodiment according to the invention creates an apparatus for providing an upmix signal representation on the basis of a downmix signal representation and an object-related parametric information, which are included in a bitstream representation of an audio content, and in dependence on a rendering information. The apparatus comprises a distortion limiter configured to adjust upmix parameters (e.g., gain factors or entries of a rendering matrix) using a distortion control scheme to avoid or limit audible distortions which are introduced as a consequence of an inappropriate choice of a rendering parameter (e.g., entries of a user-specified rendering matrix). The distortion limiter is configured to obtain a distortion limitation control parameter, which is included in the bitstream representation of the audio content, and to adjust the distortion control scheme in dependence on the distortion limitation control parameter.

This embodiment according to the invention is based on the key idea that significant advantages can be achieved by adjusting the distortion control scheme in dependence on a distortion limitation control parameter, which is included in the bitstream representation of the audio content because this allows for a control of the distortion control scheme, which is applied at the side of an audio decoder (e.g., an apparatus for providing an upmix signal representation), using control information (e.g., the distortion limitation control parameter), which is provided by the audio encoder (e.g., an apparatus for providing a bitstream representing a multi-channel audio signal). Accordingly, an audio signal encoder has a chance to control the decoder-sided distortion control scheme, which in turn gives the encoder the possibility to hand over more or less freedom to the user of the decoder with respect to an adjustment of the rendering parameters. Accordingly, the audio signal encoder, which typically comprises a better knowledge of the audio signal objects represented by the downmix signal representation, can contribute to properly adjust the distortion control scheme using its knowledge of the audio object signals. This allows for improved results when providing the upmix signal representation. Also, the audio signal encoder may provide an appropriate distortion limitation control parameter in accordance with the requirements of the content provider providing the audio object signals which are represented by the downmix signal representation, such that an excessive degradation of the upmix signal representation by an inappropriate setting of the rendering parameters can be prevented from the side of the audio signal encoder, for example, in accordance with the requirements of the content provider.

To summarize, a large number of advantages can be obtained by the inventive approach to evaluate a distortion limitation control parameter, which is extracted at the decoder side from the bitstream representation of the audio content, to adjust, for example, one or more parameters of a distortion control scheme applied at the decoder side.

In an advantageous embodiment, the apparatus for providing an upmix signal representation is configured to receive a desired rendering matrix from an input interface. In this case, the distortion limiter is configured to obtain a modified rendering matrix in dependence on the desired rendering matrix and one or more distortion limitation control parameters. The apparatus for providing the upmix signal representation is configured to provide the upmix signal representation in dependence of the modified rendering matrix. Accordingly, the distortion limitation control parameter, which is extracted by the audio signal decoder (e.g., the apparatus for providing an upmix signal representation) from the bitstream representation of the audio content, can be used to provide a modified rendering matrix, which avoids excessive audible distortions within the upmix signal representation. A reduction of audible distortions can be achieved even if the desired rendering matrix input via the input interface (for example, by a user) is inappropriate (and would cause significant audible distortions in the upmix signal representation). Thus, the distortion limitation control parameter can be evaluated by the distortion limiter to determine how the modified rendering matrix is obtained in dependence on the desired rendering matrix from the input interface, thereby providing some degree of control to an audio signal encoder.

In an advantageous embodiment, the distortion limiter is configured to obtain one or more rendering matrix limit values, which are included in the bitstream representation of the audio content, and which describe minimum and maximum values of the rendering matrix elements (also designated as entries). In this case, the distortion limiter is further configured to limit one or more entries of the modified rendering matrix in accordance with the one or more rendering matrix limit values when obtaining the modified rendering matrix in dependence on the desired rendering matrix. Accordingly, the distortion limitation control parameters, which comprise the rendering matrix limit values, can be used to avoid extreme rendering settings, which are identified as being undesirable by an audio signal encoder providing the bitstream representation of the audio content. Thus, audible distortions, which would be introduced as a consequence of an inappropriate setting of the rendering parameters, can be avoided, or at least limited.

In an advantageous embodiment, the distortion limiter is configured to obtain the modified rendering matrix in dependence of the desired rendering matrix, a reference rendering matrix and the one or more distortion limitation control parameters. The usage of a reference rendering matrix brings along particular advantages, because the reference rendering matrix may specify a rendering setup which provides a sufficiently good or even an optimal quality of the upmix signal representation. Accordingly, allowable changes of the rendering parameters with respect to said reference rendering matrix can be defined by the distortion limitation control parameters, which allows for an efficient specification of ranges in which the modified rendering parameters should lie.

In an advantageous embodiment, the distortion limiter is configured to limit one or more entries of the modified rendering matrix relative to the reference rendering matrix (or relative to entries of the reference rendering matrix) in accordance with the one or more rendering matrix limit values, which are described by the distortion limitation control parameters. Accordingly, the limitation of the rendering matrix can be done efficiently in accordance with the reference rendering matrix.

Also, one or more of the distortion limitation control parameters may determine how the reference rendering matrix is obtained. For example, one or more of the distortion limitation control parameters may specify a filter time constant for deriving the entries of the reference rendering matrix. However, other configuration information, which describes how the reference rendering matrix is obtained, may also be defined by one or more of the distortion limitation control parameters.

In an advantageous embodiment, the distortion limiter is configured to apply object-individual distortion limitation control parameters in order to obtain the modified rendering matrix in dependence on the desired (e.g., user-specified) rendering matrix. Accordingly, differences of the audio object signals, which are well known to an audio signal encoder providing the bitstream representation of the audio content, can be considered by the distortion control scheme by exploiting the object-individual distortion limitation control parameters, which are extracted from the bitstream representation of the audio content.

In an advantageous embodiment, the apparatus for providing an upmix signal is configured to apply one or more modified gain factors to audio samples of the downmix signal representation, or to an object-related side information associated with audio objects described by the downmix signal, to provide the upmix signal representation in dependence on the modified gain factors. In this case, the distortion limiter is configured to obtain the one or more modified gain factors in dependence on one or more desired gain factors and the one or more distortion limitation control parameters. Accordingly, the distortion limitation control parameters, which are extracted from the bitstream representation of the audio content, are used for an appropriate adjustment of the gain factors, which allows for the control of the (appropriate) choice of the gain factors from the side of an audio signal encoder providing the bitstream representation of the audio content.

In an advantageous embodiment, the distortion limiter is configured to derive a reference level for a gain parameter to be limited using a smoothing filter having a time constant. In this case, the distortion limiter is configured to use the reference level for limiting the given parameter. Also, the distortion limiter is configured to obtain a time constant parameter, which is included in the bitstream representation of the audio content (e.g., by extracting the time constant parameter from the bitstream representation of the audio content) and to adjust the smoothing filter time constant in dependence on the time constant parameter. Thus, an audio signal encoder, which knows the temporal characteristics of the audio object signals better than the audio signal decoder (apparatus for providing an upmix signal representation), can include an appropriate time constant parameter, which allows for a meaningful derivation of a reference level, in the bitstream representation of the audio content for application by an audio signal decoder. Therefore, specific characteristics of the audio signal, which are known to an audio signal encoder, can be exploited by the distortion control scheme.

In an advantageous embodiment, the parameter limiter is configured to obtain a distortion control activation parameter, which is included in the bitstream representation of the audio content, and to enable or disable the distortion control scheme in dependence on the distortion control activation parameter. Accordingly, an audio signal encoder, which provides the bitstream representation of the audio content, may enforce an activation of the distortion control scheme, or may deactivate the distortion control scheme. Accordingly, the audio signal encoder providing the bitstream representation of the audio content may selectively enforce that an appropriate distortion control scheme is applied by an audio signal decoder, which helps to avoid user dissatisfaction for audio contents which are critical, according to the assessment of the audio encoder or the content provider. The audio signal encoder may provide an appropriate limitation of the setting of the rendering parameters in this case. On the other hand, the audio decoder may selectively disable the distortion control scheme, to provide maximum flexibility with respect to the setting of the rendering parameters to a user, for audio contents for which such maximum flexibility brings along a better user satisfaction than the application of a distortion control scheme.

In an advantageous embodiment, the parameter limiter is configured to obtain a preset rendering matrix activation parameter, which is included in the bitstream representation of the audio content. In this case, the parameter limiter is configured to enforce, in response to an active state of the preset rendering matrix activation parameter, that a preset rendering matrix information included in the bitstream representation of the audio content is used, rather than a user-specified rendering matrix information, for providing the upmix signal representation on the basis of the downmix signal representation. Accordingly, the audio signal decoder may achieve, in some situations, that the upmix signal representation is obtained using a rendering matrix information defined by the audio signal encoder, rather than by the user. Accordingly, the audio signal encoder has the chance to include the preset rendering matrix information into the bitstream and to activate the preset rendering matrix activation parameter (or flag), indicating that the preset rendering matrix information should be used by the audio signal decoder. Accordingly, the audio signal decoder can ensure that an artistic value of the audio content, which may be given by an appropriate setting of the rendering matrix in accordance with the preset rendering matrix information, becomes apparent for the user. Accordingly, a user dissatisfaction, which could occur in such cases in which only an appropriate setting of the rendering parameters provides a good hearing impression, can be avoided.

In an advantageous embodiment, the parameter limiter is configured to obtain a psychoacoustic distortion limitation parameter, which is included into the bitstream representation of the audio content. In this case, the distortion limiter is configured to adjust one or more upmix parameters in dependence on a psychoacoustic distortion model, such that a measure (which may be, for example, an estimate) of distortions caused by the derivation of the upmix signal representation from the downmix signal representation is limited. In this case, the distortion limiter is configured to set one or more parameters used for adjusting the one or more upmix parameters in dependence on the psychoacoustic distortion model (for example, a parameter describing how to adjust the one or more upmix parameters in dependence on an output value of the psychoacoustic distortion model), or one or more parameters of the psychoacoustic distortion model, in dependence on the psychoacoustic distortion limitation parameter. Accordingly, the usage of a psychoacoustic distortion model for an appropriate limitation of the upmix parameters (e.g. rendering parameters) can be controlled from the side of an audio encoder, which again gives the audio encoder the possibility to contribute to an avoidance of a significant distortion of the upmix signal representation.

In an advantageous embodiment, the distortion limiter is configured to obtain an updated distortion limitation control parameter once per audio frame, to obtain a time-variant distortion control scheme. This concept brings along the advantage that the distortion control scheme can be adjusted dynamically under the control of an audio signal encoder, which provides the one or more distortion limitation control parameters within the bitstream representation of the audio content, such that a strict or relaxed distortion control scheme can be selected by the audio encoder. In this way, the audio signal encoder can provide the user with a maximum possible flexibility, by adjusting the distortion control scheme to be relaxed by providing appropriate distortion limitation control parameters within the bitstream representation of the audio content, for less-critical passages of an audio content, and with less flexibility, by adjusting the distortion control scheme to be strict by providing appropriate distortion limitation control parameters, for more critical audio frames. Thus, a good trade-off between the user's flexibility and the hearing impression can be achieved by an appropriate control, which can be effected from the side of the audio encoder by the use of the audio decoder discussed here.

In an advantageous embodiment, the distortion limiter is configured to evaluate a dynamic update flag within a configuration portion of the bitstream representation of the audio content. In this case, the distortion limiter is configured to evaluate the configuration portion of the bitstream representation of the audio content to obtain the distortion limitation control parameter, if the dynamic update flag is inactive, and to evaluate frame portions of the bitstream representation of the audio content to repeatedly obtain updates of the distortion limitation control parameter, if the dynamic update flag is active. Accordingly, the audio decoder can be switched between a static mode, in which the one or more distortion limitation control parameters are transferred only once per sequence of audio frames (to which sequence a single, common configuration portion is associated, for example), and a dynamic mode of operation, in which the one or more distortion limitation control parameters are transmitted more frequently or even once per audio frame. This allows for an adaptation of the transmission of the distortion limitation control parameters, to obtain a low bitrate of the distortion limitation control parameters if a temporal variation of the distortion limitation control parameters is unnecessary and to obtain a good temporal resolution of the distortion limitation control parameters if this is desirable, for example, due to the characteristics of the audio object signals.

In an advantageous embodiment, the distortion limiter is configured to selectively update the distortion limitation control parameter in dependence on a flag indicating the presence of a distortion limitation control parameter in a frame portion of the audio content, such that update intervals (measured, for example, in terms of audio frames) for the distortion limitation control parameters are determined dynamically by the bitstream representation of the audio content. Accordingly, in a single piece of audio information comprising multiple audio frames, an update of the distortion limitation control parameters can be performed at irregular instances or time (for example, with an irregular number of audio frames in between), which may be well-adapted to temporally irregular variations of the audio object signals.

An embodiment according to the invention creates an apparatus for providing a bitstream representation of a multichannel audio signal. The apparatus comprises a downmixer configured to provide a downmix signal on the basis of a plurality of audio object signals. Also, the apparatus comprises a side information provider configured to provide an object-related parametric side information describing characteristics of the audio object signals and downmix parameters, and one or more distortion limitation control parameters for controlling the application of a distortion control scheme at the side of an apparatus for providing an upmix signal representation. The apparatus for providing a bitstream also comprises a bitstream formatter configured to provide a bitstream comprising a representation of the downmix signal, the object-related parametric side information and the one or more distortion limitation control parameters.

Said apparatus for providing a bitstream representing a multi-channel audio signal is well-suited for the provision of the bitstream representation of the audio content, which is usable by the above-discussed apparatus for providing an upmix signal representation. The apparatus for providing a bitstream allows for the inclusion of the distortion limitation control parameters into to bitstream, such that the decoder-sided distortion control scheme can be adjusted in accordance with desires defined at the encoder side.

For further details and advantages, reference is made to the above discussion of the apparatus for providing an upmix signal representation.

Another embodiment according to the invention creates a method for providing an upmix signal representation on the basis of a downmix signal representation and an object-related parametric information, which are included in a bitstream representation of an audio content, and in dependence on a rendering information.

Another embodiment according to the invention creates a method for providing a bitstream representing a multi-channel audio signal.

Another embodiment according to the invention creates a computer program for performing one of said methods.

The methods and the computer program are based on the same key ideas as the above-discussed apparatus.

Another embodiment according to the invention creates a bitstream representing a multi-channel audio signal. The bitstream comprises a representation of the downmix signal combining audio signals of a plurality of audio objects and an object-related parametric side information describing characteristics of the audio objects. The bitstream also comprises one or more distortion limitation control parameters for controlling the application of a distortion control scheme at the side of an apparatus for providing an upmix signal representation. Said bitstream is typically provided by the above-discussed apparatus for providing a bitstream representing a multi-channel audio signal, and can typically be evaluated by the above-discussed apparatus for providing an upmix signal representation. The bitstream allows for an efficient adjustment of the distortion control scheme.

BRIEF DESCRIPTION OF THE DRAWINGS

Embodiments according to the present invention will subsequently be described taking reference to the enclosed figures, in which.

DETAILED DESCRIPTION OF THE INVENTION

1. Apparatus for Providing an Upmix Signal Representation, According to FIG. 1

Figure 1:
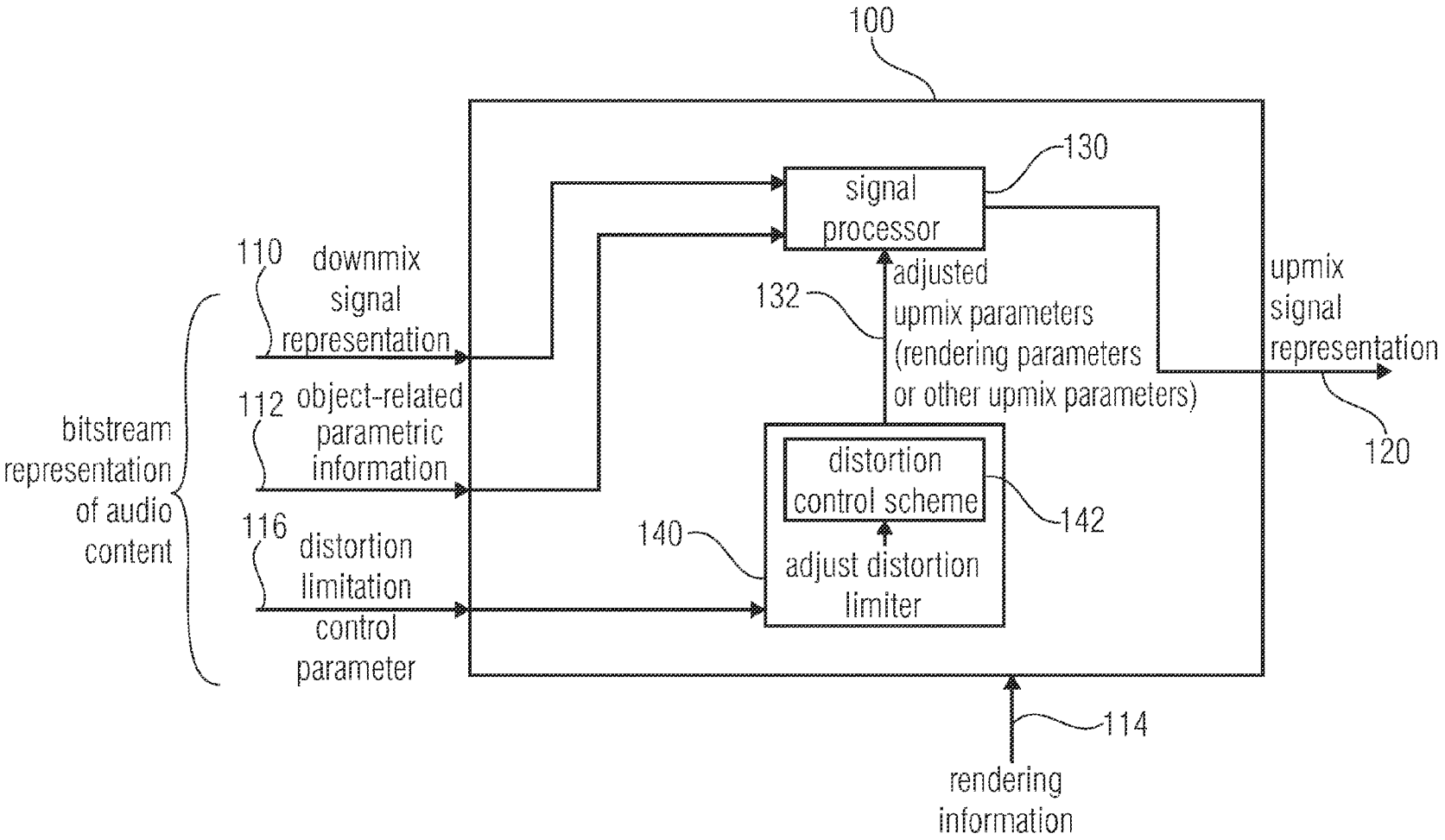
FIG. 1 shows a block schematic diagram of an apparatus for providing an upmix signal representation, according to an embodiment of the invention.

FIG. 1 shows a block schematic diagram of an apparatus 100 for providing an upmix signal representation 120 on the basis of a downmix signal representation 110 and an object-related parametric information 112 (which may be considered as a parametric side information). The downmix signal representation 110 and the object-related parametric information 112 may both be included in a bitstream representation of the audio content. The apparatus 100 may be configured to provide the upmix signal representation in dependence on a rendering information 114, which may be input, for example, using a user interface. The apparatus 100 may receive one or more distortion limitation control parameters 116, which are typically also included in the bitstream representation of the audio content.

The apparatus 100 comprises a signal processor 130, which is configured to provide the upmix signal representation 120 in dependence of the downmix signal representation 110 and the object-related parametric information 112, taking into account adjusted upmix parameters 132. The apparatus 100 comprises a distortion limiter 140 configured to obtain the adjusted upmix parameters 132 using a distortion control scheme 142, to avoid or limit audible distortions which are caused by an inappropriate choice of rendering parameters of the rendering information 114. The distortion limiter 140 is configured to obtain one or more distortion limitation control parameters 116, which are included in the bitstream representation of the audio content, and to adjust the distortion control scheme in dependence on the one or more distortion limitation control parameters 116.

In the following, the functionality of the apparatus 100 will be discussed in more detail. The signal processor 130 provides the upmix signal representation 120. For this purpose, the downmix signal representation 110 and the object-related parametric information 112 are considered. Also, an attempt is made in most cases (but not necessarily in all cases) to provide the upmix signal representation 120 in accordance with the rendering information 114, which is provided, for example, by a user via a user interface. However, if the rendering information 114 were to be used without a distortion control scheme, this would sometimes lead to audible distortions of the upmix signal representation 120, for example, if extreme rendering settings were chosen by a user. In order to avoid excessive audible distortions, adjusted upmix parameters 132 (which may be rendering parameters or other upmix parameters) are provided by the distortion limiter 140 on the basis of the rendering information 114 and using the distortion control scheme 142.

The distortion control scheme 142 is adapted to derive the adjusted upmix parameters 132 from the rendering information 114 using an adjustable mapping rule, which may, for example, comprise a linear, piece-wise linear or non-linear mapping. The distortion control scheme 142 may be adjusted in dependence on one or more distortion control scheme adjustment parameters by the distortion limiter 140. For this purpose, the distortion limiter 140 may consider the one or more distortion limitation control parameters 116, which are included in the bitstream representation of the audio content, and which are advantageously extracted from the bitstream representation of the audio content using a bitstream parser not shown in FIG. 1 (which may nevertheless be part of the apparatus 100 in some embodiments). The distortion control scheme 142 (or the mapping rule defining the distortion control scheme) may in some embodiments take into account information of the downmix signal representation 110 and/or of the object-related parametric information 112 to obtain the adjusted upmix parameters 132 in dependence on the rendering information 114. The distortion control scheme adjustment parameters, which are advantageously used to adjust the distortion control scheme, may, for example, comprise limiting parameters, linear combination parameters, or other functional parameters defining a mapping of the rendering information 114 onto the adjusted upmix parameters 132.

To summarize, the distortion limiter 140 provides the adjusted upmix parameters 132 such that an excessive audible distortion of the upmix signal representation 120 is avoided, even if the rendering information 114 is chosen in an appropriate manner and would, without the application of the distortion control scheme 142, result in an excessive distortion of the upmix signal representation 120. Thus, the distortion limiter using and adjusting the distortion control scheme 142 helps to improve the hearing impression. By making the adjustment of the distortion control scheme 142 dependent on the one or more distortion limitation control parameters 116, which are included in the bitstream representation of the audio content, a control of a reduction of distortions can be effected from the side of an audio signal encoder providing the bitstream representation of the audio content.

2. Apparatus for Providing an Upmix Signal Representation, According to FIG. 2

In the following, an apparatus 200 for providing an upmix signal representation on the basis of a downmix signal representation and an object-related parametric information, which are included in a bitstream representation of an audio content, and in dependence on a rendering information will be described taking reference to FIG. 2, which shows a block schematic diagram of such an apparatus 200.

Figure 2:
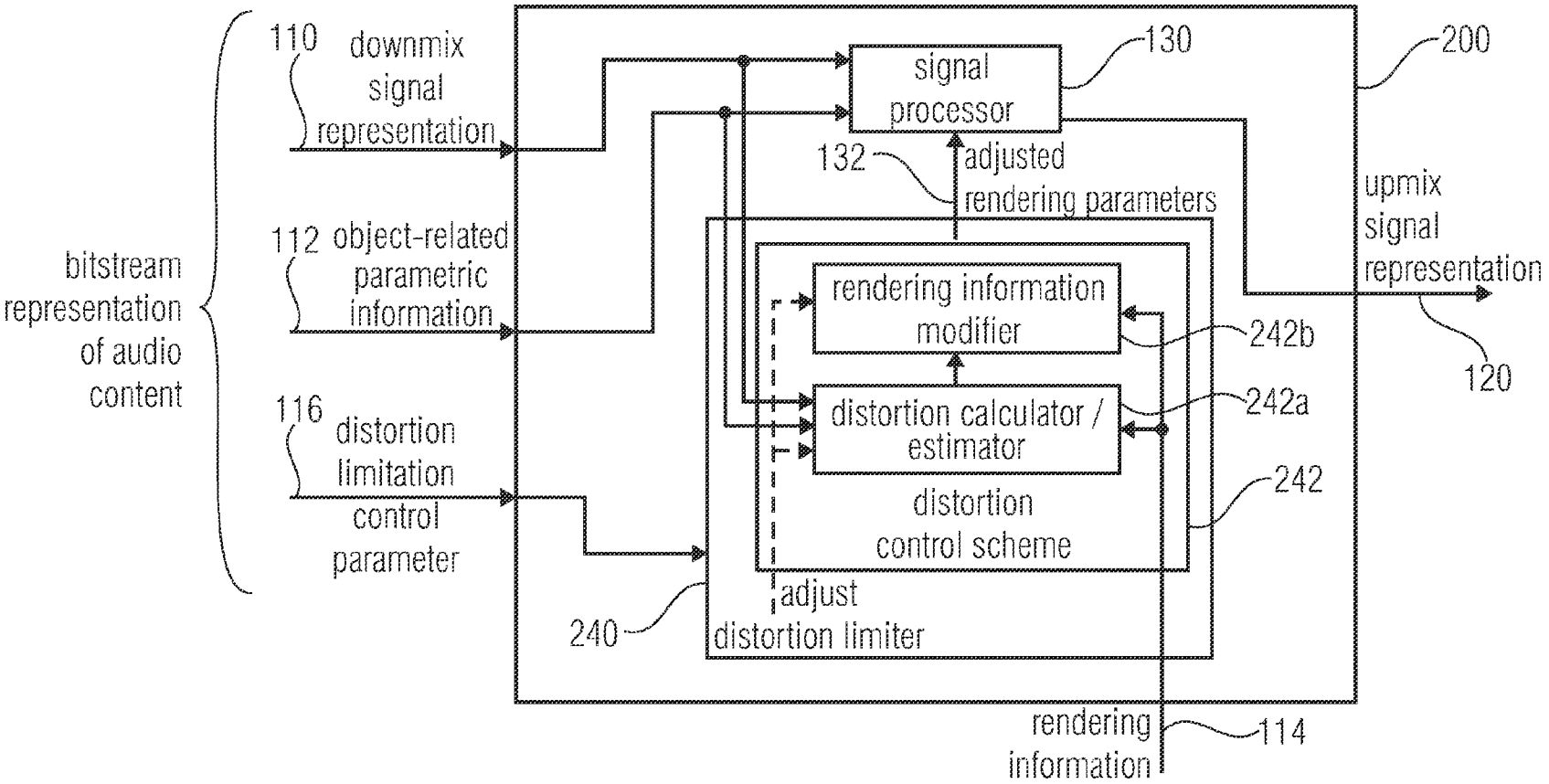
FIG. 2 shows a block schematic diagram of an apparatus for providing an upmix signal representation, according to another embodiment of the invention.

It should be noted here that the information received by the apparatus 200 in FIG. 2 and the information provided by the apparatus 200 is similar to the information received and provided by the apparatus 100, such that identical reference numerals are used to identify identical information. Also, some of the means of the apparatus 200 are identical to means of the apparatus 100, such that identical reference numerals are used throughout the entire description for such identical or equivalent means.

The apparatus 200 is configured to receive the downmix signal representation 110, an object-related parametric information 112, a rendering information 114, and one or more distortion limitation control parameters 116. Also, the apparatus 200 is configured to provide an upmix signal representation 120 using, for example, a signal processor 130.

The apparatus 200 comprises a distortion limiter 240, which uses a distortion control scheme 242. The distortion control scheme 242 comprises a distortion calculator/estimator 242*a* and a rendering information modifier 242*b*. The distortion calculator/estimator 242*a* is, for example, configured to receive at least a part of the downmix signal representation 110 and at least a part of the object-related parametric information 112, and the rendering information 114. The distortion calculator/estimator 242*a* is configured to calculate or estimate a measure of distortions, which would be introduced into the upmix signal representation 120 by applying the rendering information 114 to the downmix signal representation 110, taking into consideration the object-related parametric information 112. The rendering information modifier 242*b* is configured to provide the adjusted rendering parameters 132 on the basis of the rendering information 114, taking into consideration the calculated or estimated distortion information provided by the distortion calculator/estimator 242*a*, such that the adjusted rendering parameters 132 result in a reduced distortion, when compared to the original rendering parameters 114, when applied by the signal processor 130 to obtain the upmix signal representation 120.

However, the rendering information modifier 242*b* may take into consideration a distortion control scheme adjustment parameter, which is provided by the distortion limiter 240 in dependence on the distortion limitation control parameter 116, and which affects the provision of the adjusted rendering parameters 132.

For example, the distortion control scheme adjustment parameter (which is obtained on the basis of the distortion limitation control parameter 116, or which is even identical to the distortion limitation control parameter 116) may, for example, define how the distortion measure is calculated or estimated by the distortion calculator/estimator 242*a*. For example, said distortion control scheme adjustment parameter may define how different distortions are weighted absolutely, or with respect to each other, to obtain a calculated or estimated distortion value. Alternatively, or in addition, the distortion control scheme adjustment parameter may determine how the distortion measure obtained by the distortion calculator/estimator 242*a* affects the provision of the adjusted rendering parameters 132 on the basis of the rendering information 114.

In some embodiments, the distortion calculator/estimator 242*a* and the rendering information modifier 242*b* may also be combined, such that the adjusted rendering parameters 132 are provided such that the adjusted rendering parameters 132 bring along a certain (limited) degree of distortion of the upmix signal representation 120, wherein this degree of distortion of the upmix signal representation 120 can be affected (or adjusted) by the distortion control scheme adjustment parameter.

3. Apparatus for Providing an Upmix Signal Representation, According to FIG. 3

Figure 3:
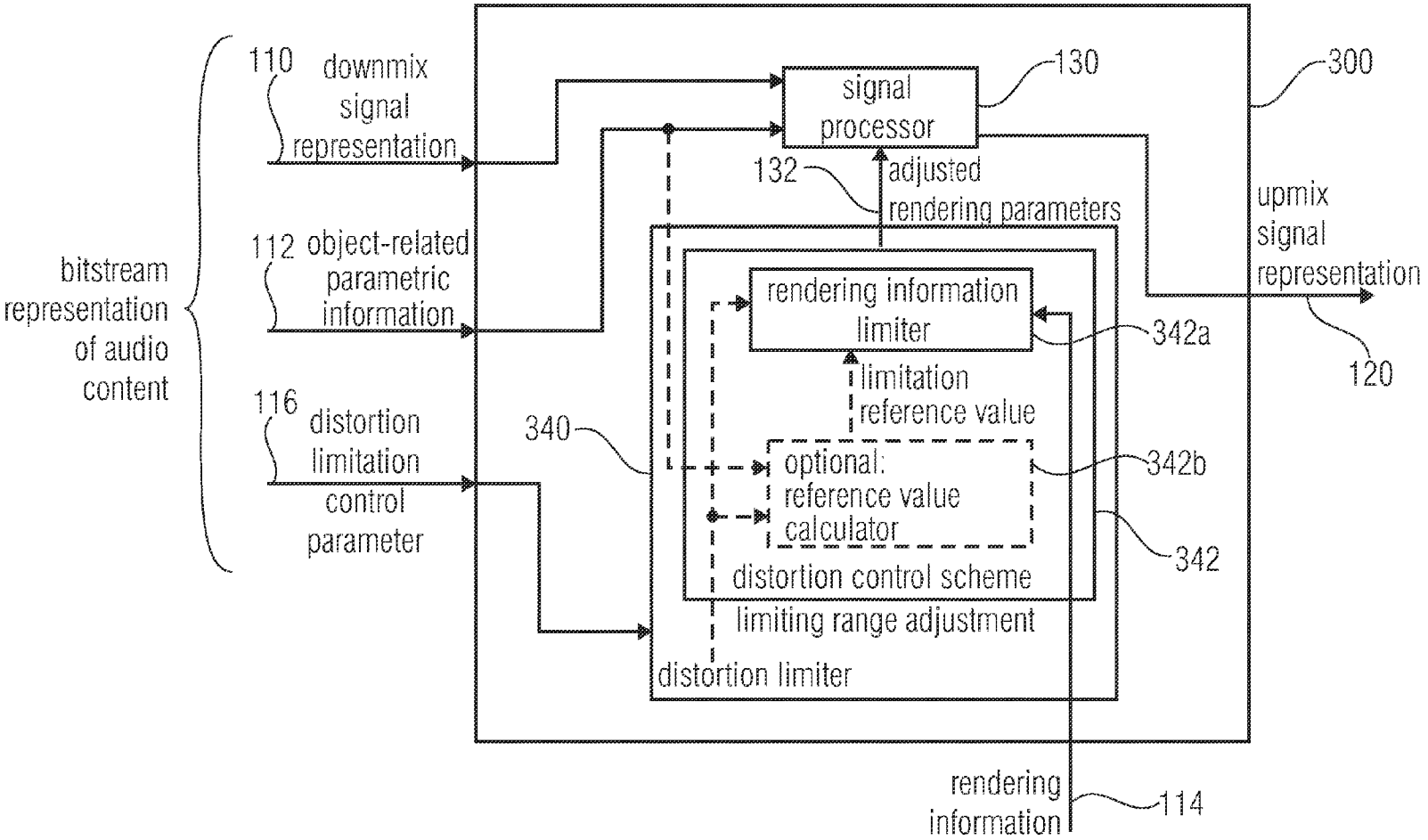
FIG. 3 shows a block schematic diagram of an apparatus for providing an upmix signal representation, according to another embodiment of the invention.

In the following, an apparatus 300 for providing an upmix signal representation 120 on the basis of a downmix signal representation 110 and an object-related parametric information 112, which are included in the bitstream representation of an audio content, and in dependence on a rendering information 114 will be described taking reference to FIG. 3. It should be noted here that identical reference numerals designate identical or equivalent information, means and functionalities in the discussion of the embodiments herein.

The apparatus 300 comprises a distortion limiter 340, which is configured to use a distortion control scheme 342, and to provide adjusted upmix parameters 132 in dependence on the rendering information 114 and also in dependence on the distortion limitation control parameter 116.

The distortion control scheme 342 comprises a rendering information limiter 342*a* which is configured to limit a numeric range of values of the rendering information 114 to obtain the adjusted rendering parameters 132. The limitation of the values of the rendering information 114 may be performed in dependence on a distortion control scheme adjustment parameter, which is obtained by the distortion limiter 340 in dependence on the distortion limitation control parameter 116, or which is even identical to the distortion limitation control parameter 116. The distortion control scheme 342 may optionally comprise a reference value calculator 342*b* which may be configured to provide a limitation reference value in dependence on the object-related parametric information 112 and, advantageously but not necessarily, also in dependence on a distortion control scheme adjustment parameter which is derived from, or identical to, a distortion limitation control parameter 116. Accordingly, the rendering information limiter 342 may optionally consider the limitation reference value provided by the reference value calculator 342*b* when limiting the numeric range of values of the rendering information in a process of obtaining the adjusted rendering parameters 132.

Accordingly, the distortion limiter 340 may implement an adjustable limitation of the numeric range of values of the rendering information 114, so as to derive the adjusted rendering parameters 132 from the values of the rendering information 114, which may be a user-specified rendering information. The adjustable limitation may be adjusted in dependence on the one or more distortion limitation control parameters 116, wherein the distortion limitation control parameters 116 may determine one or more different parameters of the adjustable limitation (e.g., a minimum value, a maximum value, an allowable deviation from a reference value, a reference value calculation mode, etc.).

4. SAOC Distortion Control with Inventive Bitstream Signaling, According to FIG. 4

4.1 Architectural Overview

Figure 4:
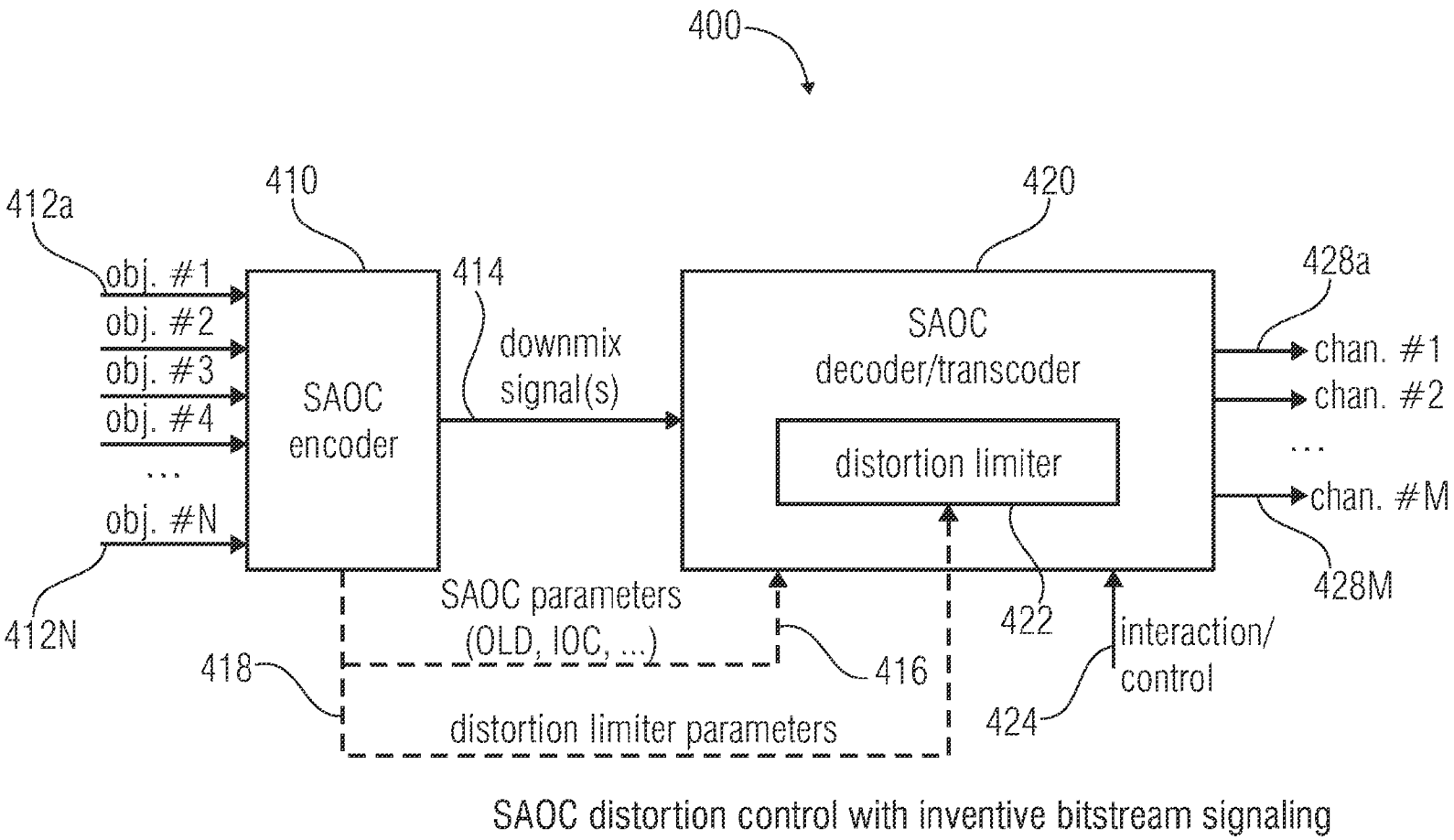
FIG. 4 shows a block schematic diagram of an SAOC distortion control with the inventive bitstream signaling.

In the following, the concept of SAOC distortion control with the inventive bitstream signaling will be discussed taking reference to FIG. 4, which shows a block schematic diagram of an SAOC distortion control system 400.

The SAOC distortion control system 400 comprises an SAOC encoder 410 and an SAOC decoder/transcoder 420.

The SAOC encoder 410 is configured to receive a plurality of audio object signals 412*a* to 412N and to provide, on the basis thereof, a downmix signal 414. The downmix signal 414 may, for example, be equivalent to the downmix signal representation 110, and may be a 1-channel signal or a multichannel signal, such as, for example, a 2-channel signal.

The SAOC encoder 410 is also configured to provide an object-related parametric information 416, which comprises for example, SAOC parameters. The SAOC parameters may, for example, describe characteristics of the audio object signals 412*a* to 412N. For example, the SAOC parameters may describe object level differences (OLDs) of the audio objects represented by the audio object signals 412*a* to 412N. Also, the SAOC parameters may describe an inter-object correlation IOC of the audio objects represented by the audio object signals 412*a* to 412N. Also, the SAOC parameters may characterize the downmix, which is performed to derive the downmix signal 414 by linearly combining the audio object signals 412*a* to 412N. For example, the SAOC parameters may describe a downmix gain DMG and downmix channel level differences DCLD. The SAOC parameters 416 may, for example be equivalent to the object-related parametric information 112.

The SAOC decoder 410 may also provide one or more distortion limiter parameters 418, which may be considered as one or more distortion limitation control parameters, and which may be equivalent to the distortion limitation control parameters 116.

The downmix signal representation 414, the SAOC parameters 416 and the distortion limiter parameters 418 are transmitted from the SAOC encoder 410 to the SAOC decoder and/or SAOC transcoder 420.

Typically, the downmix signal representation 414 (advantageously in an encoded form), the SAOC parameters 416 (typically in an encoded form) and the distortion limiter parameters 418 (typically in encoded form) are all included in a bitstream representation of the audio content. In other words, the SAOC encoder 410 provides a bitstream which includes the parameters 414, 416, 418.

Figure 8:
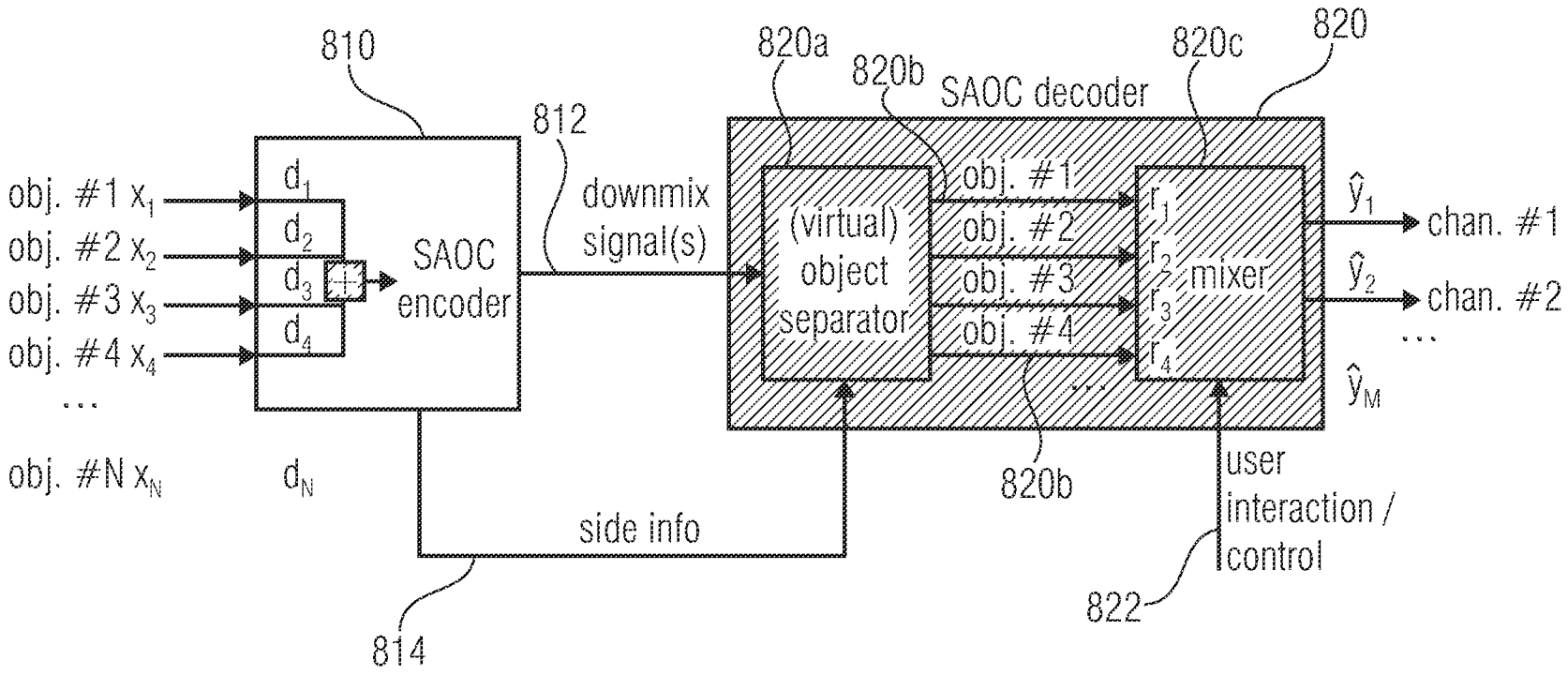
FIG. 8 shows a block schematic diagram of a reference MPEG SAOC system.
Figure 9A:
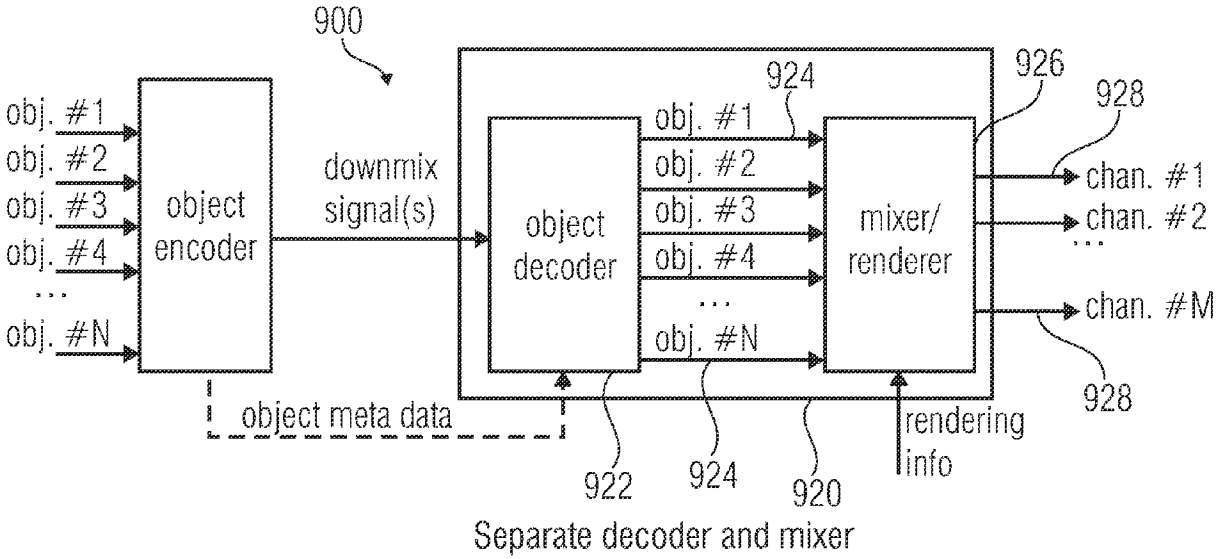
FIG. 9*a* shows a block schematic diagram of a reference SAOC system using a separate decoder and mixer.
Figure 9B:
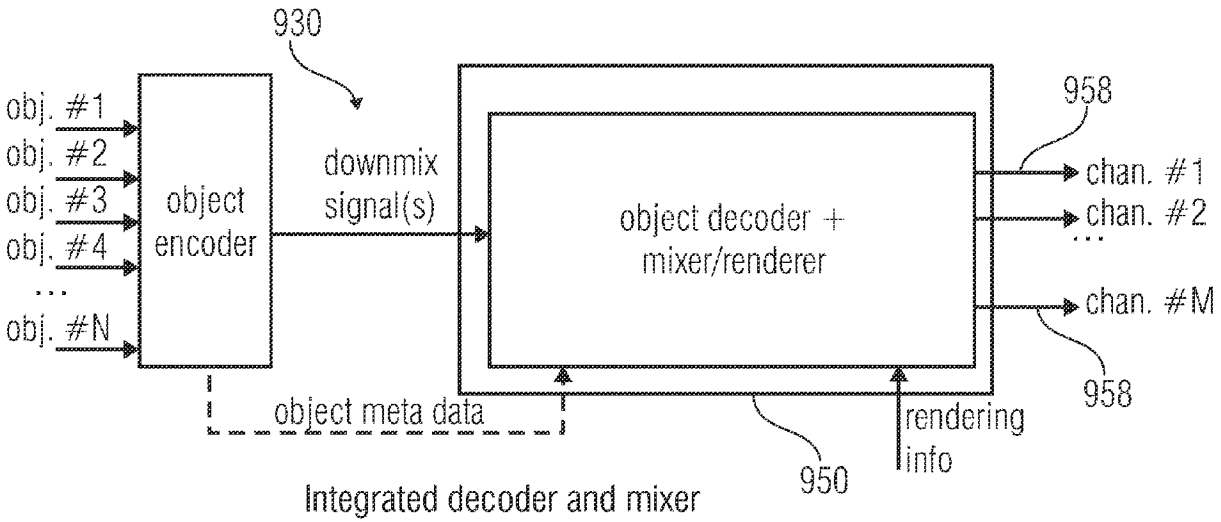
FIG. 9*b* shows a block schematic diagram of a reference SAOC system using an integrated decoder and mixer.
Figure 9C:
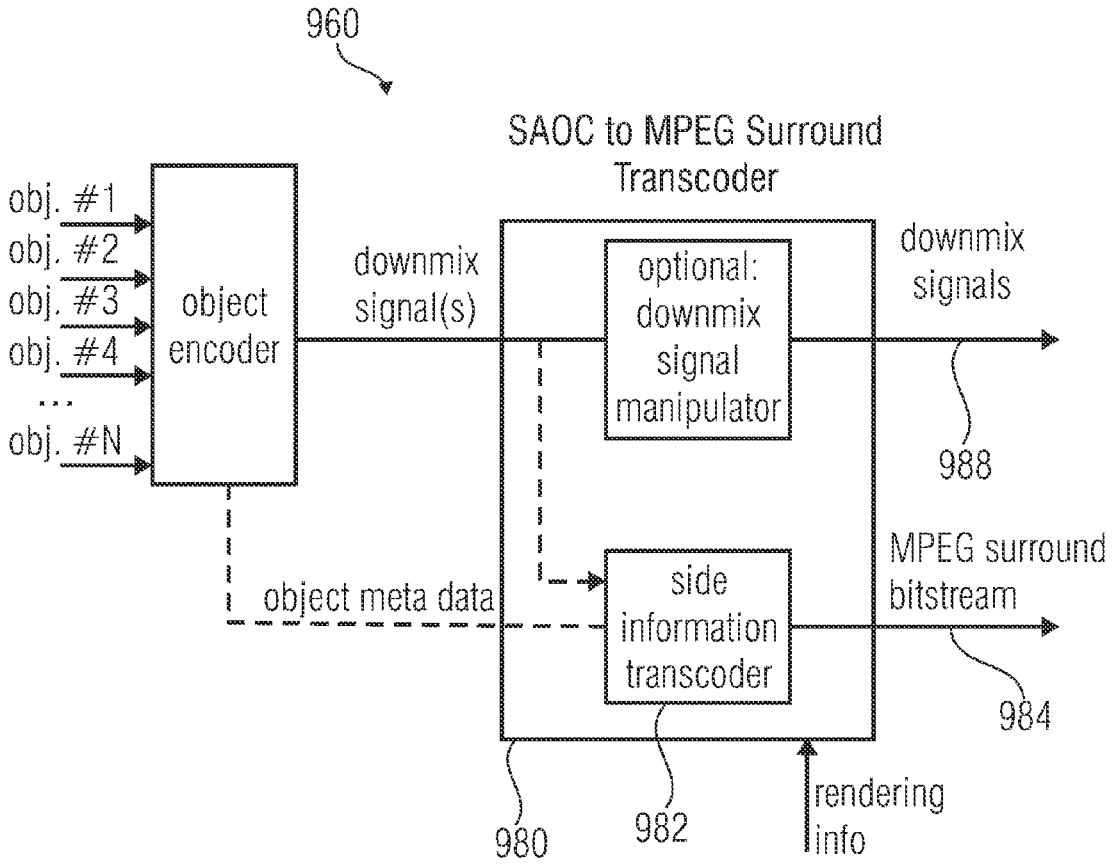
FIG. 9*c* shows a block schematic diagram of a reference SAOC system using an SAOC-to-MPEG transcoder.

The SAOC decoder or SAOC transcoder or SAOC decoder/transcoder 420 receives the downmix signal representation 414, the SAOC parameters 416, and the one or more distortion limiter parameters 418. The SAOC decoder/transcoder 420 may, for example, perform the functionality of the SAOC decoder 820 according to FIG. 8, of the SAOC decoder 920 according to FIG. 9*a*, of the integrated decoder and mixer 950 according to FIG. 9*b*, or of the SAOC-to-MPEG Surround transcoder 980 of FIG. 9*c*.

However, in addition to said SAOC decoders or transcoders, the SAOC decoder/transcoder 420 comprises a distortion limiter 422, which is configured to receive and evaluate the one or more distortion limiter parameters 418. Moreover, the SAOC decoder/transcoder 420 may be configured to also receive an interaction/control information 424 which represents, for example, a user's choice of desired rendering parameters. The SAOC decoder/transcoder 420 is consequently configured to provide an upmix signal representation, for example, in the form of a plurality of decoded audio signal channels 428*a* to 428M.

The SAOC decoder/transcoder 420 is configured to apply gain factors or rendering parameters to derive the upmix signal representation 428*a* to 428M from the downmix signal 414. For example, the SAOC decoder/transcoder 420 may be configured to multiply signal components (e.g., spectral domain values) representing the downmix signal 414 (which may be a 1-channel downmix signal or a 2-channel downmix signal) with a plurality of corresponding gain values (e.g., a matrix of gain values) to derive the audio channel signals 428*a* to 428M from the downmix signal representation. For example, a linear combination of two or more channels of the downmix signal representation 414 may be formed to obtain a representation of one of the audio channel signals 428*a* to 428M. Alternatively, or in addition, a set of rendering parameters may be applied to map a representation of one or more downmix signals 414 onto the audio channel signals 428*a* to 428M. In this case, the rendering parameters may be used to compute the mapping rule for mapping the representation of the one or more downmix signals 414 onto the audio channel signals 428*a* to 428M. For example, the rendering parameters may serve as linear factors when determining such a mapping rule. However, a different application of the rendering parameters may also be possible in some embodiments.

4.2 Distortion Limitation Techniques

In the following, some techniques for the limitation of distortion will be described, which can be applied in the SAOC decoder/transcoder 420 and also in the SAOC decoders or transcoders 100, 200, 300.

Distortion limitation can be achieved by limiting the value range of some of the parameters in the SAOC decoder/transcoder system. Here, the parameters refer to coefficients, gain factors, or matrix elements in the system which do not directly represent audio samples but do affect the output audio samples by a mathematical scheme in SAOC.

Of special interest can be to apply the limitation on the transcoding parameters (i.e., the individual elements in the transcoding matrix). This is computationally efficient because the transcoding matrix does not grow with the number of objects. The transcoding matrix may describe a mapping of audio channel signals of the downmix signal representation onto audio channel signals of the upmix signal representation.

Figure 7:
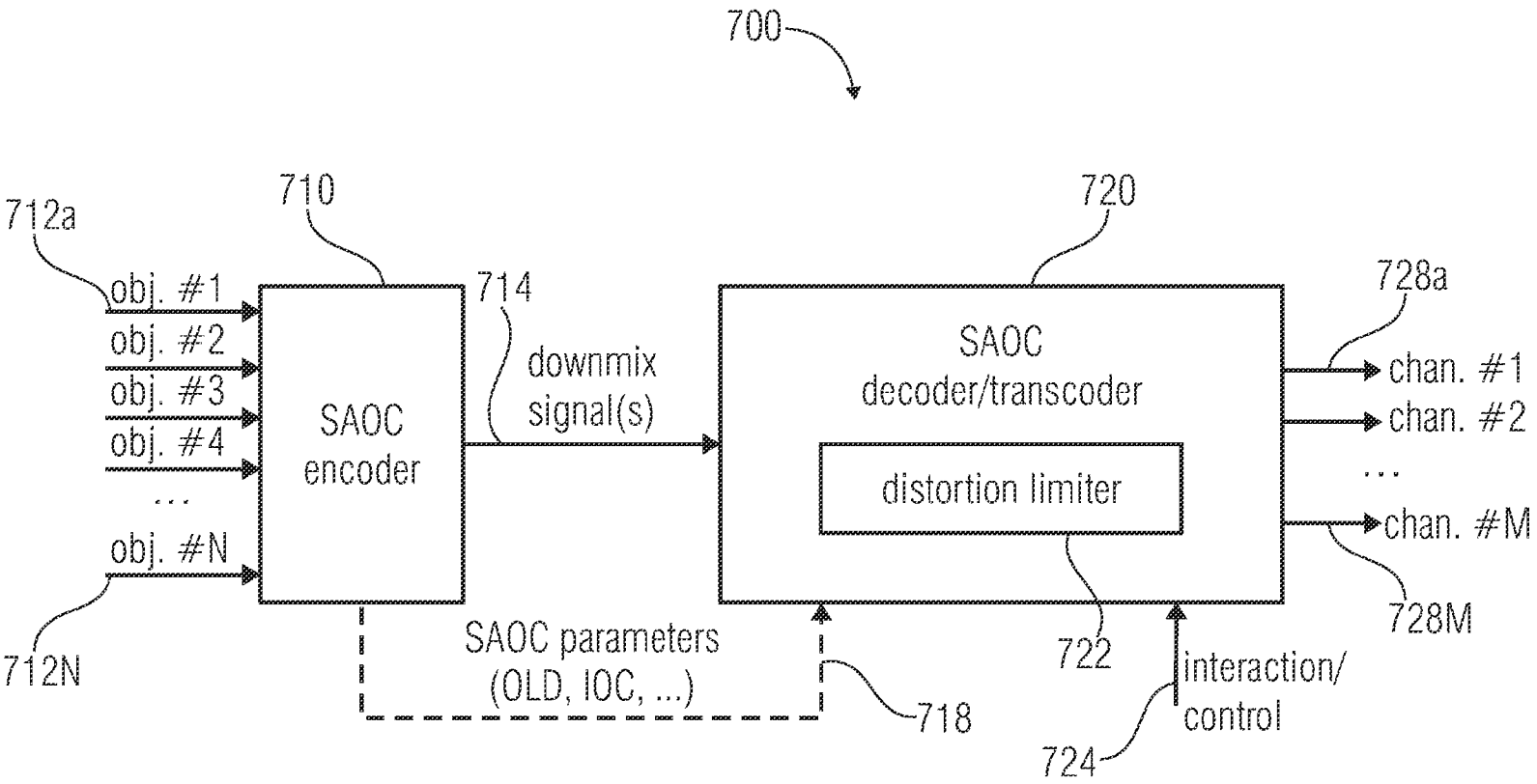
FIG. 7 shows a block schematic diagram of an example for SAOC distortion control.

The distortion limiter in the SAOC decoder/transcoder, which is shown, for example, in FIGS. 2 and 7, performs its limitation of the parameter range based on one or more gain limitation constants. The parameters that are subject to limitation can be gain factors to be applied to the audio samples. Then, the one or more gain limitation constants can be expressed as a gain level range in decibels.

For example, a gain limitation constant of q=10 dB can be used to limit the range of the parameter, p according to:

$$p' = \begin{cases} q, & p > q \\ -q & p < -q \\ p, & \text{otherwise} \end{cases}$$

Here, p' is defined as the new limited parameter (to replace p). Both p, p' and q are here expressed as logarithmic (decibel) values.

It should be noted here that the value p' may, for example, represent the adjusted upmix parameters 132, and that the values p may be obtained in dependence of the rendering information. The limitation of the range of the values p' may, for example, be performed by the distortion control scheme, and the distortion limiter 140 may adjust the parameter q (which may be considered a distortion control scheme adjustment parameter) in dependence of the distortion limitation control parameter 116. The above rule for obtaining p' may be considered as an adjustable distortion control scheme, which is adjusted in dependence on the distortion control scheme adjustment parameter q.

A more advanced approach is to allow the gain limitation constant, q define the maximal allowed deviation from another reference level for the parameter. This reference level could, for example, be derived from a smoothed/filtered/averaged version (smoothed/filtered/averaged along the time axis) of the parameter sequence (as it is updated, e.g., once or several times every SAOC frame). Then the limitation can be defined according to:

$$p'' = \begin{cases} r+q, & p > r+q \\ r-q & p < r-q \\ p, & \text{otherwise} \end{cases}$$

Here, p" is defined as the new more advanced limited parameter (to replace p), and r is defined as the smoothed/filtered/averaged version (smoothed/filtered/averaged along the time axis) of the parameter sequence of p. Both, p, p", r and q are here expressed as logarithmic (decibel) values.

For example, the value p" may represent the one or more adjusted parameters 132 (for example, adjusted transcoding parameters or adjusted rendering parameters). The value p may be obtained, for example, in dependence on the rendering information 114 and optionally, other information, such as, for example, the information from the downmix signal representation 110 or the information from the object-related parametric information 112.

The limitation of the values of p, to obtain p", may be performed by the distortion control scheme, and the parameter q may be adjusted by the distortion limiter 140 in dependence on the distortion limitation control parameter 116. Additionally, a smoothing/filtering/averaging time constant, which is used to obtain r by smoothing the values of p, may also be adjusted by the distortion limiter 140 in dependence on one or more of the distortion limitation control parameters.

Another limitation method operates only on the rendering matrix. The rendering matrix is an input interface (or input quantity) to the SAOC decoder/transcoder. Hence, this method does not require any modification inside the SAOC decoder/transcoder system.

A simple limitation method limits the range (sets minimum and maximum values) of the rendering matrix elements.

An alternative limitation method limits modifications of the rendering matrix elements relative to a rendering matrix reference. The rendering matrix reference can be, for example, the rendering matrix that results in an unaltered downmix as an output. For example, a limitation parameter, q=10 dB prevents the rendering matrix elements from deviating from a certain reference value (or from individual reference values) more than ±10 dB (i.e. no less than a factor 10^(−10/20), no more than a factor 10^(10/20)).

The range for the parameters (matrix elements) in the rendering matrix can easily be different for the individual objects, since they are well-isolated in the rendering matrix. For example, the following limited ranges could be allowed:

drum object: ±3 dB
bass-object: ±10 dB
Mellotron Object: ±6 dB
Guitar1-object: ±3 dB
Guitar2-object: ±3 dB
Vocal-object: ±0 dB
Flute-object: ±12 dB In other words, an adjustment range for individual rendering parameters may be adjusted (set) individually, i.e., in an object-individual manner. The object-individual variation ranges may be obtained from a plurality of distortion limitation control parameters 116 which are included in the bitstream representation of the audio content and which are extracted from said bitstream representation of the audio content by a bitstream parser. Accordingly, the audio encoder can efficiently forward to the audio decoder (e.g., the apparatus 100, 200, 300, 420) an information about the object-individual adjustment ranges. The encoder-sided provision of the object-individual adjustment ranges brings along particular advantages due to the fact that the object types are known with good accuracy at the side of the encoder, such that the encoder is best-suited for providing reliable information on the allowed adjustment ranges.

In the following, the inventive flexible limitation approach will be discussed in further detail.

To overcome the limitations of conventional concepts, the present invention proposes using data guiding the distortion control scheme to perform optimal in each situation. This data (i.e., data for adjusting the distortion control scheme, for example, distortion limitation control parameters) can be set at the SAOC encoder side and are conveyed in the SAOC bitstream to be available later for the distortion control scheme in the SAOC decoder/transcoder. This is illustrated in FIG. 4 (and can also be seen in FIGS. 1, 2 and 3)

The conveyed data ("labeled distortion limiter parameters" in FIG. 4 and designated as distortion limitation control parameters 116 in FIGS. 1, 2, and 3) can include information about:

Parameter Limiting Values:

e.g., the gain limitation constant, q which has been explained in the above examples;

e.g., a limiting range or limiting ranges (e.g. minimum and maximum values) of rendering matrix elements;

e.g., a limiting range or limiting ranges of rendering matrix elements relative to a rendering matrix reference (e.g., the rendering matrix that results in an unaltered downmix as output);

e.g., a time constant for a smoothing filter that is used for deriving the reference level of the parameter (to be limited) from a smoothed/filtered/averaged version of the parameter;

Special Limitation Cases:

no modifications allowed at all (temporary disable SAOC's rendering functionality);

only rendering matrix presets (read from bitstream) allowed;

no limitations (temporary disable SAOC's distortion limiter);

any distortion control limiting parameters from psychoacoustic distortion measure model discussed in some distortion control.

To summarize to above, a gain limitation constant q, which is used for limiting a numeric range of one or more gain factors or one or more rendering matrix elements can be extracted from the SAOC bitstream.

Alternatively, or in addition, one or more parameters limiting a range of a rendering matrix element, or limiting the ranges of rendering matrix elements (e.g. in an object-individual manner) can be extracted from the SAOC bitstream.

Alternatively, or in addition, one or more parameters limiting a range of a rendering matrix element relative to a rendering matrix reference or limiting ranges of rendering matrix elements relative to a rendering matrix reference can be extracted from the SAOC bitstream.

Alternatively, or in addition, a time constant for a smoothing filter that is used for deriving the reference level of the parameter to be limited can be extracted from the SAOC bitstream.

In some cases, the bitstream may comprise a parameter or flag indicating that the SAOC rendering functionality should be disabled.

Alternatively, or in addition, the SAOC bitstream may comprise a parameter or flag indicating that a preset rendering matrix, which is described by the SAOC bitstream, or one out of a plurality of preset rendering matrices described by the bitstream, should be used for rendering the upmix signal representation, rather than a user-provided rendering matrix input via a user interface. Accordingly, the user's freedom to set a user-defined rendering matrix may be temporarily disabled by the audio decoder/transcoder, if the audio decoder/transcoder identifies this condition on the basis of a bitstream parameter or a bitstream flag.

Alternatively, or additionally, the SAOC bitstream may comprise a flag or parameter indicating that the SAOC distortion limiter should be temporarily disabled, such that there are no distortion limits.

Alternatively, or in addition, the SAOC bitstream may comprise a parameter for adjusting the distortion limitation based on a psychoacoustic distortion measure model. Thus, the distortion limiter may adjust a distortion control scheme, which is based on a psychoacoustic distortion model, in dependence on a parameter extracted from the SAOC bitstream. For example, the distortion limiter may adjust any of the distortion limitation schemes described in PTC/EP 2010/055717 (and also in U.S. 61/173,456) in dependence on a distortion limitation control parameter extracted from the SAOC bitstream.

4.3 Advantages of the Flexible Limitation Approach

The inventive signaling of SAOC distortion control scheme data, which has been described in detail above, can potentially solve all limitations of conventional distortion control approaches.

It should be noted that there are limitations of conventional distortion control approaches due to lack of flexibility, which can be overcome in embodiments according to the invention. Some of these limitations, which can be overcome using embodiments of the invention, are:

The distortion control parameters in the conventional distortion control do not adapt to be optimal for every situation.

It has been found that choosing distortion control parameters that are optimal (from an audio quality/quality of service point of view) is often dependent on, for example:

content type: speech, music (rock/classical), movie audio track, etc.

low-level signal properties: transients, harmonic-to-noise structure, spectral slope, dynamic fine-structure (fast/slow temporal power envelope), etc.

SAOC properties: number of controllable objects present in the downmix, degree of object separation/overlap in time/frequency/downmix-channel, etc.

System properties: downmix codec type (mp3, AAC, PCM, etc) and bitrate (indicating overall audio quality and distortion in the downmix), presence of parametric coded parts in downmix (e.g. SBR, as included in HE-AAC, see references [SBR1], [SBR2], or parametric stereo, as described in reference [PS]), channel configuration (mono, stereo, multi-channel), audio bandwidth, sampling rate, etc.

The distortion control parameters are inaccurate because the original audio objects are normally not available at the SAOC decoder side.

It has been found that extracting the distortion control parameters can benefit from analysis of the original (discrete) audio objects since they are clean/undistorted and not parametrically decomposed from the downmix. These original objects are normally not available at the SAOC decoder side.

A conventional audio encoder has no possibility to ensure a decoder-sided rendering quality.

It has been found that for some SAOC applications, it is desirable to set a minimum quality level from the encoder side. It has been found that it is then desired that this minimum quality level is achieved independent of the user interaction (choice of rendering matrix and playback configuration) at the decoder side. While some distortion control aims at a constant quality level set to the SAOC decoder side, it can be desirable to have different quality levels for different services (e.g. teleconferencing, high quality music download, broadcast applications) due to, for example, artist integrity, reputation/profile of the service provider, expectation of user skills (level of user interface functionality versus easiness to use).

Inventive signaling of SAOC distortion control scheme data (e.g., from an audio encoder to an audio decoder via a bitstream) can potentially solve all limitations discussed earlier. For example, the SAOC decoder can use different distortion limitation settings (different quality/functionality-limiting settings which are described, for example by the distortion limitation control parameter 116 or the distortion limiter parameters 418) for, e.g., teleconference applications, dialogue control applications (in audio books or broadcasting), music re-mix ("music 2.0") applications.

This present invention provides both further enhanced performance and functionalities by utilizing signaling in the bitstream to guide the distortion control process.

5. Reference Example

In the following, a reference example for SAOC distortion control will be described taking reference to FIG. 7, which does not bring along all of the inventive advantages. The system 700 according to FIG. 7 comprises an SAOC encoder 710 and an SAOC decoder/transcoder 720. The SAOC encoder 710 receives a plurality of audio object signals 712*a* to 712N and provides, on the basis thereof, a downmix signal 714, and SAOC parameters 718. The SAOC decoder/transcoder 720 receives the downmix signal 714 (which will be a 1-channel signal or a multi-channel signal) and the SAOC parameters 718 from the SAOC encoder 710. The SAOC decoder/transcoder 720 provides, on the basis thereof, a plurality of audio signal channels 728*a* to 728M. For this purpose, the SAOC decoder/transcoder 720 may use a distortion limiter 722 and may consider an interaction information or control information 724 which is received, e.g. from a user interface.

However, the system 700 according to FIG. 7 typically brings along audible distortions in some cases.

6. Apparatus for Providing a Bitstream Representing a Multi-Channel Audio Signal, According to FIG. 5

Figure 5:
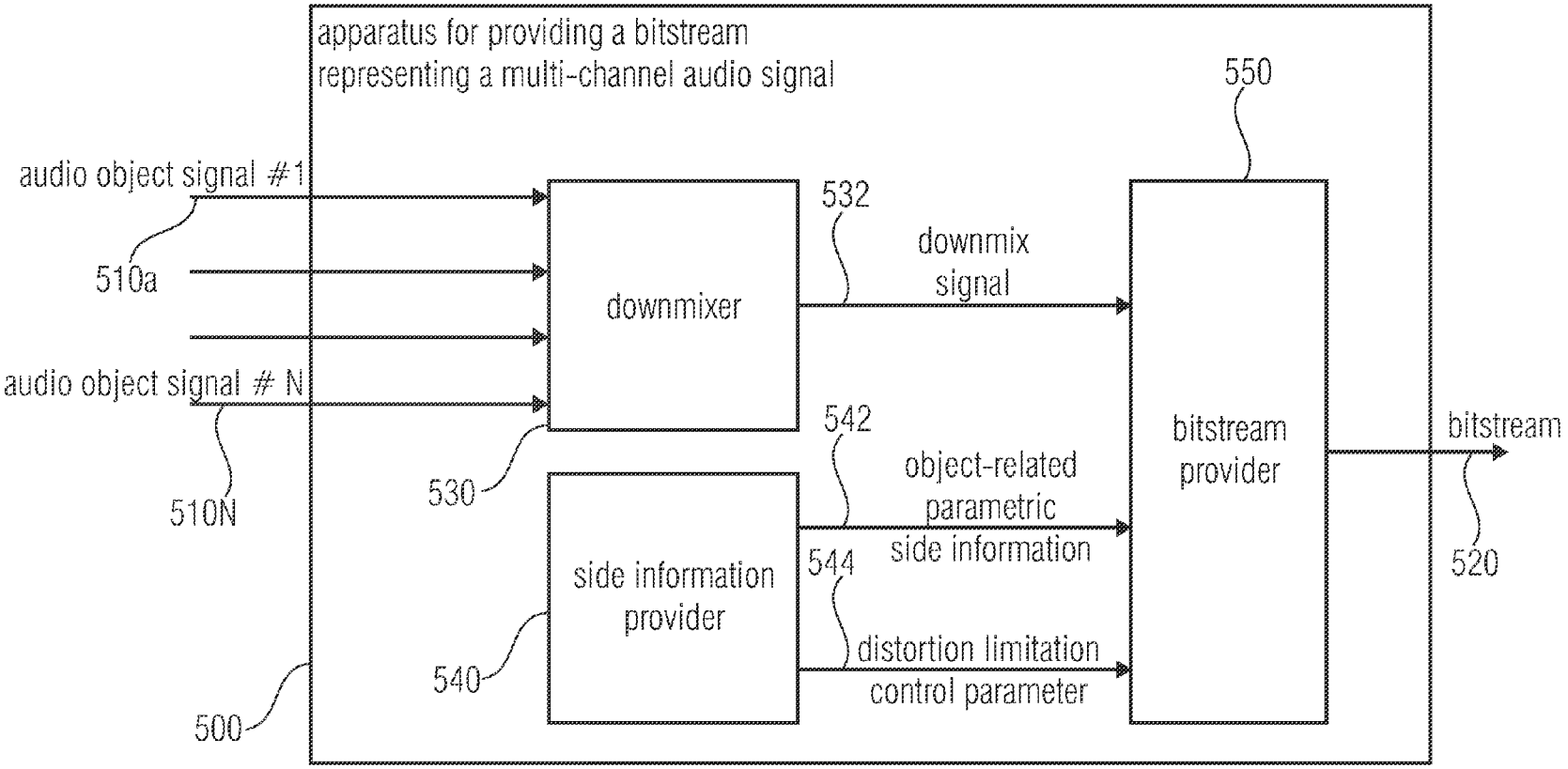
FIG. 5 shows a block schematic diagram of an apparatus for providing a bitstream representing a multi-channel audio signal, according to an embodiment of the invention.
Figure 6:
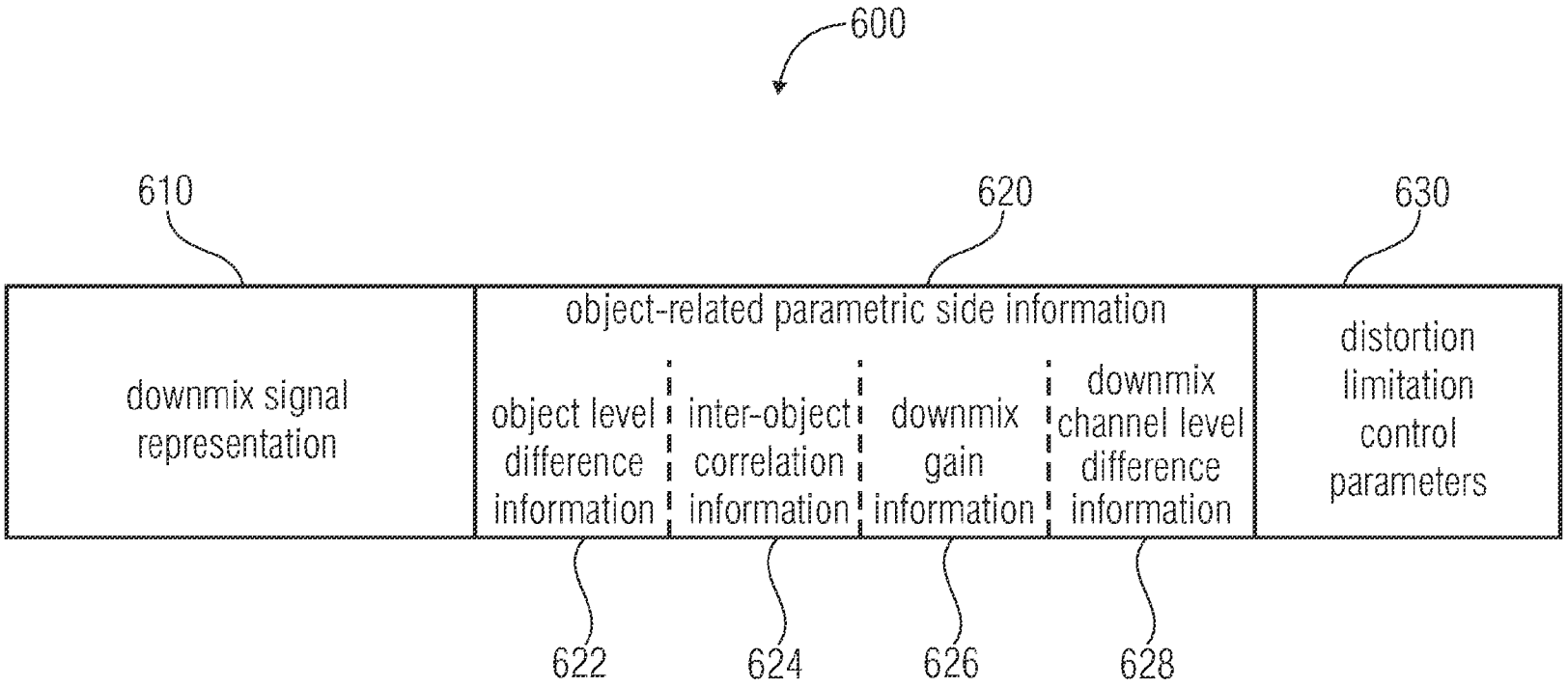
FIG. 6 shows a schematic representation of a bitstream representing a multi-channel audio signal, according to an embodiment of the invention.

In the following, an apparatus for providing a bitstream representation of a multi-channel audio signal will be described taking reference to FIG. 5, which shows a block schematic diagram of such an apparatus 500.

The apparatus 500 is configured to receive a plurality of audio object signals 510*a* to 510N. Also, the apparatus 500 is configured to provide a bitstream 520 representing the multi-channel audio signal.

The apparatus 500 comprises a downmixer 530, which is configured to provide a downmix signal 532 on the basis of the plurality of audio object signals 510*a* to 510N. The apparatus 500 also comprises a side information provider 540, which is configured to provide an object-related parametric side information 542 describing the characteristics of the audio object signals 510*a* to 510N and downmix parameters applied by the downmixer 530. The side information provider is configured to also provide one or more distortion limitation control parameters 544 for controlling the application of a distortion control scheme at the side of an apparatus for providing an upmix signal representation. The apparatus 500 also comprises a bitstream formatter 550, which is configured to provide the bitstream 520 comprising a representation of the downmix signal 532, the object-related parametric side information 542 and the one or more distortion limitation control parameters 544.

Accordingly, the apparatus 500 provides a bitstream 520 which comprises the information that may be used to adjust the distortion control scheme 142, 242, 342, in the apparatus 100, 200, 300, and the distortion limiter 422 in the apparatus 420.

The side information provider 540 may be configured to provide the distortion limitation control parameter 544 in dependence on audio object properties of the audio object signals 510*a* to 510N. For example, the side information provider may provide the distortion limitation control parameter 544 in dependence on a content type information obtained on the basis of the audio object signals 510*a* to 510N, or provided using a side information (e.g., input via a user interface).

Alternatively, or in addition, the side information provider 540 may provide the distortion limitation control parameters in dependence on low level properties, for instance, information about transients, information on a harmonic-to-noise structure, information on a spectral slope, information on a dynamic fine structure, etc., of one or more of the audio object signals 510*a* to 510N.

Alternatively, or in addition, the side information provider 540 may provide the distortion limitation control parameters in dependence on SAOC properties, such as a number of controllable objects present in the downmix signal 532, or in dependence on the presence of parametric coded parts in the downmix, or in dependence on a channel configuration, or in dependence on audio bandwidth, or in dependence on a sampling rate.

The side information provider 540 may benefit from an analysis of the original ("discrete") audio objects (or audio object signals 510*a* to 510N) in order to provide the distortion limitation control parameters 544. The side information provider 540 may, for example, adjust the distortion limitation control parameters to variably set a minimum quality level of the rendering of an audio signal represented by the bitstream 520.

To summarize, the apparatus 500 for providing a bitstream representation of a multi-channel audio signal may provide the bitstream 520 such that the bitstream 520 comprises one or more distortion limitation control parameters 544 and consequently allows for an adjustment of the rendering quality. For this purpose, characteristics of the audio object signals 510*a* to 510N may be taken into consideration, and additional side information or the user input from the user interface may also be taken into consideration for setting the distortion limitation control parameters 544.

7. Bitstream

In the following, a bitstream 600 representing a multi-channel audio signal will be described.

The bitstream 600 comprises a representation 610 of a downmix signal (e.g. of the downmix signal 532, which may be equivalent to the downmix signal representation 110, 414). The bitstream 600 also comprises an object-related parametric side information 620, which may be an SAOC side information. The object-related parameter side information 620 may, for example, comprise an object level difference information 622, an inter-object-correlation information 624, a downmix gain information 626 and a downmix channel level difference information 628, which side information is well-known from the field of spatial audio object coding (SAOC). The bitstream 600 also comprises one or more distortion limitation control parameters 630, as described above.

It should be noted that the inventive distortion control scheme data (i.e. the distortion limitation control parameters 630, 116, 418) can be conveyed in the header of the SAOC bitstream (e.g., in an SAOC specific configuration portion of the SAOC bitstream, which is named "SAOCSpecificConfig( )") for a minimum data-rate overhead. However, the inventive distortion control scheme data can also be conveyed in the payload data (e.g., in SAOC frame data, which are typically called "SAOCFrame( )") for enabling a time-variant signaling (e.g. signal adaptive control).

Typically, but not necessarily, a good place to put the distortion control scheme data can be using the extension mechanism in the SAOC bitstream: in some embodiments, the distortion control scheme data (or at least a part of the distortion control scheme data) can be put into the syntax sections called "SAOCExtensionConfig( )" and "SAOCExtensionFrame( )" for the header and the payload case, respectively.

In other words, in some embodiments, the distortion control scheme data can be included in the SAOC header, which is typically included in the bitstream once per piece of audio. Alternatively, or in addition, the distortion control scheme data can be included in frame data of the SAOC bitstream. Accordingly, the distortion control scheme data may be transmitted once per audio frame. A flag in the SAOC header, which comprises the SAOC configuration, may indicate which of the two solutions (distortion control scheme data only in the header or distortion control scheme data within the audio frame data) is applied.

Also, in some embodiments the distortion control scheme data may be included only in some of the audio frames, wherein it may be signaled using a parameter or flag which of the audio frames comprise the distortion control scheme data. Accordingly, the SAOC distortion control scheme data can be transferred at irregular time intervals within a single piece of audio (to which a single SAOC configuration portion is associated).

8. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

9. Conclusion

To summarize the above, embodiments according to the invention create a distortion control signaling in MPEG spatial audio object coding SAOC.

Embodiments according to the present invention provide both further enhanced performance and functionalities by utilizing a signaling in the bitstream to guide the distortion process.

Advantageous embodiments according to the invention comprise methods, apparatus, or computer programs for encoding or decoding an audio signal as discussed above. Further embodiments according to the invention comprise an encoded signal generated as discussed above, or as used by a decoder or a decoding method as discussed above.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

10. References

[BCC] C. Faller and F. Baumgarte, "*Binaural Cue Coding—Part II: Schemes and applications*", IEEE Trans. on Speech and Audio Proc., vol. 11, no. 6, November 2003.

[JSC] C. Faller, "*Parametric Joint-Coding of Audio Sources*", 120th AES Convention, Paris, 2006, Preprint 6752.

[SAOC1] J. Herre, S. Disch, J. Hilpert, O. Hellmuth: "*From SAC To SAOC—Recent Developments in Parametric Coding of Spatial Audio*", 22nd Regional UK AES Conference, Cambridge, UK, April 2007.

[SAOC2] J. Engdegård, B. Resch, C. Falch, O. Hellmuth, J. Hilpert, A. Hölzer, L. Terentiev, J. Breebaart, J. Koppens, E. Schuijers and W. Oomen: "*Spatial Audio Object Coding (SAOC)—The Upcoming MPEG Standard on Parametric Object Based Audio Coding*", 124th AES Convention, Amsterdam 2008, Preprint 7377.

[SAOC] ISO/IEC, "MPEG audio technologies—Part 2: Spatial Audio Object Coding (SAOC)", ISO/IEC JTC1/SC29/WG11 (MPEG) FCD 23003-2

[SBR1] ISO/IEC, "MPEG audio technologies—Part 2: Spatial Audio Object Coding (SAOC)," ISO/IEC JTC1/SC29/WG11 (MPEG) FCD 23003-2.

[SBR2] M. Dietz, L. Liljeryd, K. Kjoerling, and O. Kunz, "Spectral band replication, a novel approach in audio coding", in AES 112$^{th}$ Convention, Munich, Germany, May 2002, Preprint 5553.

[PS] "Low Complexity Parametric Stereo Coding in MPEG-4", Heiko Purnhagen, Proc. Digital Audio Effects Workshop (DAFx), pp. 163-168, Naples, IT, October 2004.

The invention claimed is:

1. An apparatus for providing an upmix signal representation on the basis of a downmix signal representation and an object-related parametric information, which are part of a bitstream representation of an audio content, and in dependence on a rendering information, the apparatus comprising:

a distortion limiter configured to adjust upmix parameters using a distortion control scheme to avoid or limit audible distortions which are caused by an inappropriate choice of rendering parameters, wherein the distortion limiter is configured to acquire a distortion limitation control parameter which is part of the bitstream representation of the audio content, and to adjust the distortion control scheme in dependence on the distortion limitation control parameter;

wherein the distortion limiter is configured to evaluate a dynamic update flag within a configuration portion of the bitstream representation of the audio content, and wherein the distortion limiter is configured to evaluate the configuration portion of the bitstream representation of the audio content, to acquire the distortion limitation control parameter, if the dynamic update flag is inactive, and to evaluate a frame portion of the bitstream representation of the audio content, to repeatedly acquire updates of the distortion limitation control parameter, if the dynamic update flag is active.

2. The apparatus according to claim 1, wherein the apparatus for providing an upmix signal representation is configured to receive a desired rendering matrix information from an input interface;

wherein the distortion limiter is configured to acquire a modified rendering matrix information in dependence on the desired rendering matrix information and the one or more distortion limitation control parameters; and wherein the apparatus for providing the upmix signal representation is configured to provide the upmix signal representation in dependence on the modified rendering matrix information.

3. The apparatus according to claim 2, wherein the distortion limiter is configured to acquire one or more rendering matrix limit values, which are part of the bitstream representation of the audio content and which describe minimum and maximum values of rendering matrix elements, and to limit one or more entries of the modified rendering matrix information in accordance with the one or more rendering matrix limit values when acquiring the modified rendering matrix information in dependence on the desired rendering matrix information.

4. The apparatus according to claim 2, wherein the distortion limiter is configured to acquire the modified rendering matrix information in dependence on the desired rendering matrix information, a reference rendering matrix information and the one or more distortion limitation control parameters.

5. The apparatus according to claim 4, wherein the distortion limiter is configured to limit one or more entries of the modified rendering matrix relative to the reference rendering matrix information in accordance with the one or more rendering matrix limit values.

6. The apparatus according to claim 2, wherein the distortion limiter is configured to apply object-individual distortion-limitation control parameters, in order to acquire the modified rendering matrix information in dependence on the desired rendering matrix information.

7. The apparatus according to claim 1, wherein the apparatus for providing an upmix signal representation is configured to apply one or more modified gain factors to audio samples of the downmix signal representation, or to an object-related side information associated with audio objects described by the downmix signal, to provide the upmix signal representation in dependence on the gain factors, and wherein the distortion limiter is configured to acquire the one or more modified gain factors in dependence on one or more desired gain factors and the one or more distortion limitation control parameters.

8. The apparatus according to claim 1, wherein the distortion limiter is configured to derive a reference level for a gain factor to be limited using a smoothing filter comprising a time constant, wherein the distortion limiter is configured to use the reference level for limiting the given factor, and wherein the distortion limiter is configured to acquire a time constant parameter, which is part of the bitstream representation of the audio content, and to adjust the smoothing filter time constant in dependence on the time constant parameter.

9. The apparatus according to claim 1, wherein the distortion limiter is configured to acquire a distortion control activation parameter, which is part of the bitstream representation of the audio content, and to enable or disable the distortion control scheme in dependence on the distortion control activation parameter.

10. The apparatus according to claim 1, wherein the distortion limiter is configured to acquire a preset rendering matrix activation parameter, which is part of the bitstream representation of the audio content, and wherein the distortion limiter is configured to enforce, in response to an active state of the preset rendering matrix activation parameter, that a preset rendering matrix information part of the bitstream representation of the audio content, rather than a user-specified rendering matrix information, is used for providing the upmix signal representation on the basis of the downmix signal representation.

11. The apparatus according to claim 1, wherein the distortion limiter is configured to acquire a psychoacoustic distortion limitation parameter, which is part of the bitstream representation of the audio content, wherein the distortion limiter is configured to adjust one or more upmix parameters in dependence on a psychoacoustic distortion model, such that a measure of distortions caused by the derivation of the upmix signal representation from the downmix signal representation is limited, and wherein the distortion limiter is configured to set one or more parameters used for adjusting the one or more upmix parameters in dependence on the psychoacoustic distortion model, or one or more parameters of the psychoacoustic distortion model, in dependence on the psychoacoustic distortion limitation parameter.

12. The apparatus according to claim 1, wherein the distortion limiter is configured to acquire an updated distortion limitation control parameter once per audio frame, to acquire a time-variant distortion control scheme.

13. The apparatus according to claim 1, wherein the distortion limiter is configured to selectively update the distortion limitation control parameter in dependence on a flag indicating the presence of a distortion limitation control parameter in a frame portion of the bitstream representation of the audio content, such that update intervals for the distortion limitation control parameter are determined dynamically by the bitstream representation of the audio content.

14. An apparatus for providing a bitstream representing a multi-channel audio signal, the apparatus comprising:

a downmixer configured to provide a downmix signal on the basis of a plurality of audio object signals;

a side information provider configured to provide an object-related parametric side information describing characteristics of the audio object signals and downmix parameters, and one or more distortion limitation control parameters for controlling the application of a distortion control scheme at the side of an apparatus for providing an upmix signal representation; and a bitstream formatter configured to provide a bitstream comprising a representation of the downmix signal, the object-related parametric side information and the one or more distortion limitation control parameters;

wherein the apparatus is configured to provide the bitstream such that a configuration portion of the bitstream comprises a dynamic update flag, and such that the configuration portion of the bitstream comprises the distortion limitation control parameter, if the dynamic update flag is inactive, and such that a frame portion of the bitstream comprises repeated updates of the distortion limitation control parameter, if the dynamic update flag is active.

15. A method for providing an upmix signal representation on the basis of a downmix signal representation and an object-related parametric information, which are part of a bitstream representation of an audio content, and in dependence on a rendering information, the method comprising:

adjusting upmix parameters using a distortion control scheme, to avoid or limit audible distortions which are caused by an inappropriate choice of rendering parameters, wherein a distortion limitation control parameter, which is part of the bitstream representation of the audio content, is acquired, and wherein the distortion control scheme is adjusted in dependence on the distortion limitation control parameter, wherein a dynamic update flag within a configuration portion of the bitstream representation of the audio content is evaluated, and wherein the configuration portion of the bitstream representation of the audio content is evaluated, to acquire the distortion limitation control parameter, if the dynamic update flag is inactive, and wherein a frame portion of the bitstream representation of the audio content is evaluated, to repeatedly acquire updates of the distortion limitation control parameter, if the dynamic update flag is active.

16. A method for providing a bitstream representing a multi-channel audio signal, the method comprising:

deriving a downmix signal on the basis of a plurality of audio object signals;

providing an object-related parametric side information describing characteristics of the audio object signals and downmix parameters;

providing one or more distortion limitation control parameters for controlling the application of a distortion control scheme at the side of an apparatus for providing an upmix signal representation; and providing a bitstream comprising a representation of the downmix signal, the object-related parametric side information and the one or more distortion limitation control parameters, wherein the bitstream is provided such that a configuration portion of the bitstream comprises a dynamic update flag, and such that the configuration portion of the bitstream comprises the distortion limitation control parameter, if the dynamic update flag is inactive, and such that a frame portion of the bitstream comprises repeated updates of the distortion limitation control parameter, if the dynamic update flag is active.

17. A non-transitory computer readable medium including a computer program for performing, when the computer program runs on a computer, the method for providing an upmix signal representation on the basis of a downmix signal representation and an object-related parametric information, which are part of a bitstream representation of an audio content, and in dependence on a rendering information, the method comprising:

adjusting upmix parameters using a distortion control scheme, to avoid or limit audible distortions which are caused by an inappropriate choice of rendering parameters, wherein a distortion limitation control parameter, which is part of the bitstream representation of the audio content, is acquired, and wherein the distortion control scheme is adjusted in dependence on the distortion limitation control parameter, wherein a dynamic update flag within a configuration portion of the bitstream representation of the audio content is evaluated, and wherein the configuration portion of the bitstream representation of the audio content is evaluated, to acquire the distortion limitation control parameter, if the dynamic update flag is inactive, and wherein a frame portion of the bitstream representation of the audio content is evaluated, to repeatedly acquire updates of the distortion limitation control parameter, if the dynamic update flag is active.

18. A non-transitory computer readable medium including a computer program for performing the method, when the computer program runs on a computer, for providing a bitstream representing a multi-channel audio signal, the method comprising:

deriving a downmix signal on the basis of a plurality of audio object signals;

providing an object-related parametric side information describing characteristics of the audio object signals and downmix parameters;

providing one or more distortion limitation control parameters for controlling the application of a distortion control scheme at the side of an apparatus for providing an upmix signal representation; and providing a bitstream comprising a representation of the downmix signal, the object-related parametric side information and the one or more distortion limitation control parameters, wherein the bitstream is provided such that a configuration portion of the bitstream comprises a dynamic update flag, and such that the configuration portion of the bitstream comprises the distortion limitation control parameter, if the dynamic update flag is inactive, and such that a frame portion of the bitstream comprises repeated updates of the distortion limitation control parameter, if the dynamic update flag is active.

19. A bitstream representing a multi-channel audio signal, the bitstream comprising:

a representation of a downmix signal combining audio signals of a plurality of audio objects;

an object-related parametric side information describing characteristics of the audio objects; and one or more distortion limitation control parameters for controlling the application of a distortion control scheme at the side of an apparatus for providing an upmix signal representation;

wherein a configuration portion of the bitstream comprises a dynamic update flag, and wherein the configuration portion of the bitstream comprises the distortion limitation control parameter, if the dynamic update flag is inactive, and wherein the frame portion of the bitstream comprises repeated updates of the distortion limitation control parameter, if the dynamic update flag is active.

* * * * *